US010121426B2

(12) United States Patent
Ishikawa

(10) Patent No.: US 10,121,426 B2
(45) Date of Patent: Nov. 6, 2018

(54) POLARITY INVERSION CONTROL DEVICE FOR LIQUID CRYSTAL DISPLAY, LIQUID CRYSTAL DISPLAY DEVICE, AND DRIVING METHOD THEREOF

(71) Applicant: NLT TECHNOLOGIES, LTD., Kawasaki, Kanagawa (JP)

(72) Inventor: Hiroki Ishikawa, Kanagawa (JP)

(73) Assignee: NLT TECHNOLOGIES, LTD., Kawasaki, Kanagawa (JP)

( * ) Notice: Subject to any disclaimer, the term of this patent is extended or adjusted under 35 U.S.C. 154(b) by 54 days.

(21) Appl. No.: 15/000,787

(22) Filed: Jan. 19, 2016

(65) Prior Publication Data

US 2016/0210917 A1 Jul. 21, 2016

(30) Foreign Application Priority Data

Jan. 20, 2015 (JP) ..... 2015-008285

(51) Int. Cl.
*G09G 3/36* (2006.01)

(52) U.S. Cl.
CPC ..... *G09G 3/3614* (2013.01); *G09G 2340/16* (2013.01); *G09G 2360/16* (2013.01)

(58) Field of Classification Search
CPC ..... G09G 3/3614; G09G 2310/08; G09G 2340/16; G09G 2360/16
See application file for complete search history.

(56) References Cited

U.S. PATENT DOCUMENTS

2014/0043315 A1* 2/2014 Yamazaki ..... G09G 3/3696 345/212
2015/0042627 A1* 2/2015 Kim ..... G09G 3/3685 345/204

FOREIGN PATENT DOCUMENTS

| | | | |
|---|---|---|---|
| JP | 7-175443 | A | 7/1995 |
| JP | 2014-32396 | A | 2/2014 |
| JP | 2014-32399 | A | 2/2014 |
| JP | 2014-52623 | A | 3/2014 |
| JP | 2017522586 | A | 8/2017 |
| WO | 2014002607 | A1 | 1/2014 |
| WO | 2015199910 | A1 | 12/2015 |

OTHER PUBLICATIONS

Product Name NVIDIA G-SYNC, searched on Nov. 11, 2014 (URL:http://www.nvidia.co.jp/object/how-does-g-sync-work-jp.html).
Notification of Reasons for Refusal, dated Sep. 4, 2018, issued in corresponding JP Application No. 2015-008285, 8 pages in English and Japanese.

* cited by examiner

*Primary Examiner* — Amr Awad
*Assistant Examiner* — Wing Chow
(74) *Attorney, Agent, or Firm* — Sughrue Mion, PLLC

(57) ABSTRACT

To provide a liquid crystal display device and the like capable of achieving a function with which the charging polarity for the liquid crystal panel is not deviated even when the frame rate for writing to the liquid crystal panel changes dynamically only with simple structures and low power consumption. A polarity inversion control circuit is for supplying polarity inversion signals to the liquid crystal panel, and it is characterized to switch the levels of the polarity inversion signals in such a manner that a difference between an integrated value of frame periods when the polarity inversion signal is in a first level and an integrated value of the frame periods when the polarity inversion signal is in a second level becomes small.

10 Claims, 21 Drawing Sheets

POLARITY INVERSION CONTROL DEVICE FOR LIQUID CRYSTAL DISPLAY, LIQUID CRYSTAL DISPLAY DEVICE, AND DRIVING METHOD THEREOF

CROSS-REFERENCE TO RELATED APPLICATION

This application is based upon and claims the benefit of priority from Japanese patent application No. 2015-008285, filed on Jan. 20, 2015, the disclosure of which is incorporated herein in its entirety by reference.

BACKGROUND OF THE INVENTION

1. Field of the Invention

The present invention relates to a liquid crystal display device and the like for dynamically changing a display frame rate in accordance with an inputted frame rate (referred to as fps (Frames Per Second) hereinafter. In the current Specification, referring to a case of a given structural element A, an incident where a signal B enters to the structural element A is expressed as "the structural element A inputs the signal B" and an incident B where a signal C exits from the structural element A is expressed as "the structural element A outputs the signal C".

2. Description of the Related Art

Typical liquid crystal display devices follow the stream of the old CRT (Cathode Ray Tube) display and are driven mainly with fixed fps of 60 Hz.

In the meantime, moving pictures of video games and the like are generated by rendering processing of a host processor (mainly GPU (Graphic Processor Unit). The frame rate (fps) of the moving picture data outputted to a liquid crystal display device every time the rendering processing is completed is not fixed but dynamically changes and also may be synchronized with operations of an end user in some cases.

FIG. 21 is a block diagram showing structures of a typical liquid crystal display device which shows moving pictures of video games and the periphery thereof. In FIG. 21, a GPU 102 generates image data 102*a* for displaying a video game by using rendering processing. Further, the GPU 102 may perform rendering processing that is synchronized with an operation signal 101*a* of an end user. Note that fps of the rendering processing is not fixed but changes dynamically. A display controller 103 is a signal processing device for writing image data to a liquid crystal panel, and outputs image data 103*a* towards the liquid crystal panel 104 at fixed fps of 60 Hz. An example of the display controller 103 is a signal processing circuit including a timing controller and a power supply circuit. The liquid crystal panel 104 displays the image data 103*a* inputted from the display controller 103 as a moving picture, and it also includes a driver component and the like. An example of the liquid crystal panel 104 is a TFT panel to which a source driver and a gate driver are mounted. The liquid crystal display device 100 includes the display controller 103 and the liquid crystal panel 104.

When the image data 102*a* of dynamically changing fps is transformed to the image data 103*a* of fixed fps and it is displayed on the liquid crystal panel 104, failures as in (1), (2), and (3) described below are generated due to the shift between the both kinds of fps. Such failures are perceived as discomfort by an end user 101.

(1) What is called "jerkiness" of moving pictures. It is a phenomenon where moving pictures are unable to be displayed smoothly due to generation of frame skipping when the display speed of input images is faster than the display speed of output images.

(2) Frame tearing. It is a phenomenon where images are viewed by being distorted or flickered when a plurality of screens of more than two are displayed within a display period of one screen.

(3) Time lag between a user operation and display. It is a delay of time from the point where the user does an operation to the point where an image is displayed on a liquid crystal panel.

A liquid crystal display device (referred to as "Related Technique 1" hereinafter) to which a measure for such failures is applied has already been on the market (Product Name NVIDIA G-SYNC, searched on Nov. 11, 2014 (URL: http://www.nvidia.com.jp/object/how-does-g-sync-work-jp.html) (Non-Patent Document 1)). Compared to normal liquid crystal display devices, the number of components used in Related Technique 1 is larger so that the cost is increased as well. Specifically, compared to the normal liquid crystal display devices, Related Technique 1 requires a larger-scale FPGA (Field Programmable Gate Array) and three memories so that the price thereof becomes higher by about 15,000 yen.

As a technique for suppressing the above-described failures other than Related Technique 1, there is considered a technique for dynamically changing fps for display also in accordance with inputted fps (referred to as "Related Technique 2" hereinafter). However, deviation of the charging polarities to the liquid crystal panel is an issue in the case of Related Technique 2.

That is, a normal liquid crystal panel is driven by inverting the writing polarity by each frame for preventing ghosting that is caused by deviation of the charging polarities. However, Related Technique 2 displays frames of different kinds of fps, so that charging time for the liquid crystal panel varies by each frame. Thus, even when the polarity is inverted for each frame, there is still an issue of deviation generated in the charging polarity characteristic.

Other related techniques are: Japanese Unexamined Patent Publication Hei 7-175443 (Active Matrix Type Liquid Crystal Display Device Driving method) (Patent Document 1); Japanese Unexamined Patent Publication 2014-32396 (Display Device Driving Method and Display Device) (Patent Document 2); Japanese Unexamined Patent Publication 2014-32399 (Liquid Crystal Display Device) (Patent Document 3); and Japanese Unexamined Patent Publication 2014-52623 (Liquid Crystal Display Device and Driving Method Thereof) (Patent Document 4).

Patent Document 1 discloses a double-speed driving technique for writing data with twice the fps of the data input in order to suppress ghosting of the liquid crystal panel generated by the display patterns. This technique requires a "field memory" for temporarily saving image data, a "control circuit" for controlling it, and a "synchronizing/separating circuit" for generating synchronizing signals used for driving the "control circuit".

Patent Documents 2 to 4 disclose a technique including a feature of performing drive by lowering the polarity inversion rate in order to suppress the power consumption when performing high-fps drive. This technique requires a "counter" for detecting the synchronizing signals and counting the number thereof.

With respect to Related Technique 2 described above, deviation of the polarity is decreased by employing the technique such as the one disclosed in Patent Document 1 with which writing to the liquid crystal panel is performed at a double-speed with respect to the speed of input fps.

However, Patent Document 1 requires the structures for making it possible to store image data to a memory and to perform separation of synchronizing signals and for controlling those, which results in increasing the circuit scale and the cost. Further, through processing the image data at a double-speed, inverting the polarities at a double-speed, and using a memory device, the power consumption is increased. That is, the demands for decreasing the thickness of the liquid crystal display device as well as the price thereof (i.e., simplifying the structures) and lowering the power consumption are not satisfied with such solving means.

Patent Documents 2 to 4 present techniques for suppressing the power consumed by inverting the polarities with high-fps drive. Thus, when the techniques of Patent Documents 2 to 4 are combined with the technique of Patent Document 1, the power consumed by inverting the polarities at a double-speed can be suppressed. However, the power consumed by loading the memory device and performing image data processing becomes increased, so that the power consumption is increased as a whole.

SUMMARY OF THE INVENTION

It is therefore an exemplary object of the present invention to provide a liquid crystal display device and the like capable of achieving a function with which the charging polarity to the liquid crystal panel is not deviated even when fps for writing to the liquid crystal panel changes dynamically with simple structures and low power consumption.

The polarity inversion control device for liquid crystal display according to an exemplary aspect of the invention is a device characterized to, for a liquid crystal panel which includes a plurality of pixels, applies pixel voltages of different frame periods to the pixels, and inverts polarities of the pixel voltages according to a polarity inversion signal that can employ either a first level or a second level for each of the frame periods when applying the pixel voltages to the pixels, switch the level of the polarity inversion signal in such a manner that a difference between an integrated value of the frame periods when the polarity inversion signal is in the first level and an integrated value of the frame periods when the polarity inversion signal is in the second level becomes small.

The liquid crystal display device driving method according to another exemplary aspect of the invention is a method for driving a liquid crystal display device including a liquid crystal panel which includes a plurality of pixels, applies pixel voltages of different frame periods to the pixels, and inverts polarities of the pixel voltages according to a polarity inversion signal that can employ either a first level or a second level for each of the frame periods when applying the pixel voltages to the pixels, and the method including: detecting the frame period; regarding the detected frame period, switching the level of the polarity inversion signal in such a manner that a difference between an integrated value of the frame periods when the polarity inversion signal is in the first level and an integrated value of the frame periods when the polarity inversion signal is in the second level becomes small; and supplying the switched polarity inversion signal to the liquid crystal panel.

As an exemplary advantage according to the invention, the present invention makes it possible to achieve the writing polarities of each frame with no deviation in the charging polarity without adding a memory device and the like and without inverting the polarities at a double-speed through generating the polarity inversion signals so that the time for applying the pixel voltage of the positive polarity and the time for applying the pixel voltage of the negative polarity become equivalent. Therefore, the present invention can provide the liquid crystal display device and the like capable of achieving a function with which the charging polarity for the liquid crystal panel is not deviated even when fps for writing to the liquid crystal panel changes dynamically with simple structures and low power consumption.

DETAILED DESCRIPTION OF THE PREFERRED EMBODIMENTS

Figure 1:
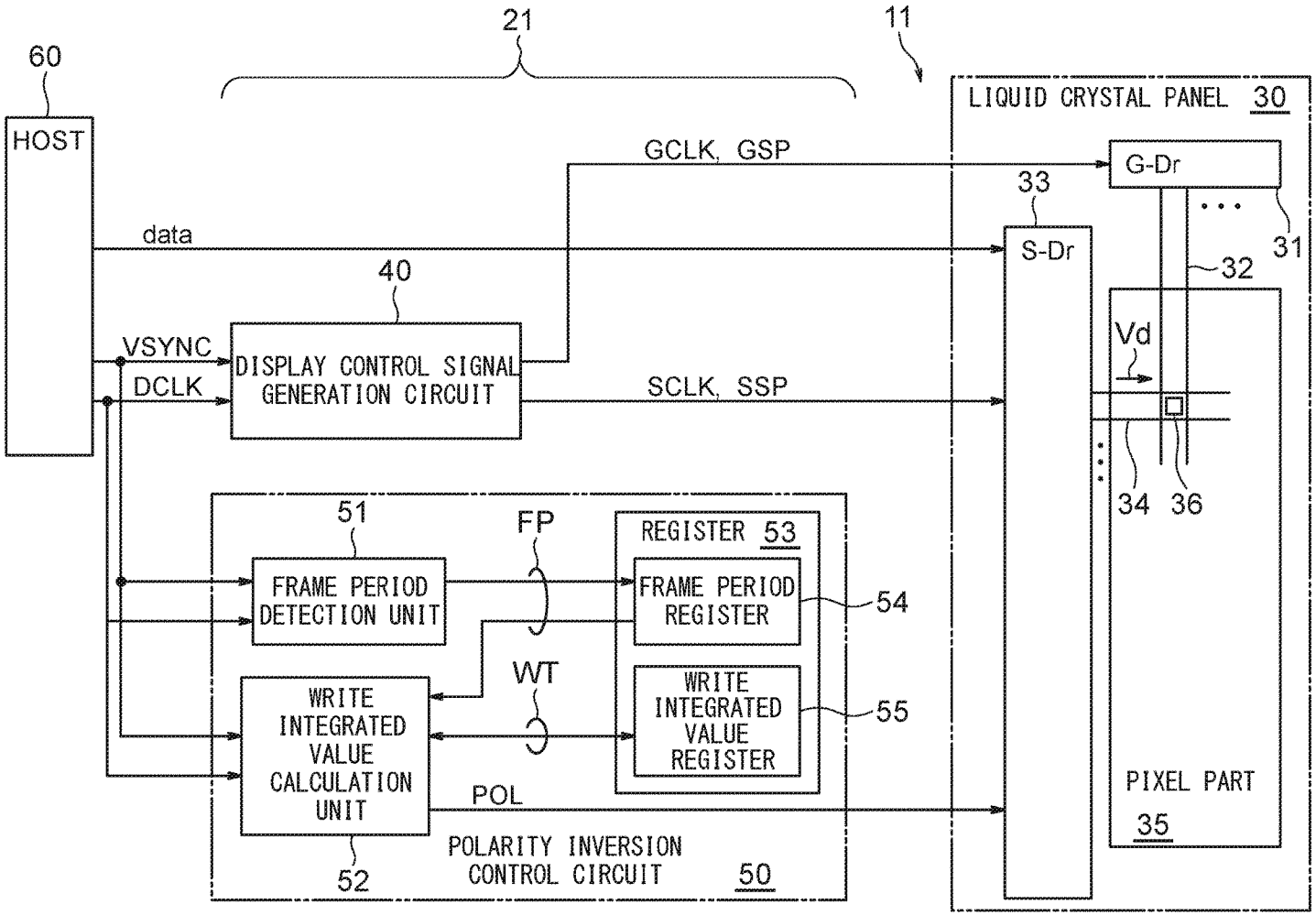
FIG. 1 is a block diagram showing the structures of a liquid crystal display device according to a first exemplary embodiment.

Hereinafter, modes for embodying the present invention (referred to as "exemplary embodiments" hereinafter) will be described by referring to the accompanying drawings. Note here that same reference numerals are applied to substantially same structural elements in the current Specification and the Drawings.

First Exemplary Embodiment

FIG. 1 is a block diagram showing the structures of a liquid crystal display device according to a first exemplary embodiment. As shown in FIG. 1, a liquid crystal display device 11 of the first exemplary embodiment includes a liquid crystal panel 30 and a polarity inversion control circuit 50 as a polarity inversion control device.

The polarity inversion control circuit 50 supplies a polarity inversion signal POL to the liquid crystal panel 30. The liquid crystal panel 30 includes a plurality of pixels 36. At the same time, the liquid crystal panel 30 applies pixel voltages Vd of different frame periods to the pixels 36 and inverts the polarity of the pixel voltage Vd according to the polarity inversion signal POL that can employ either a first level or a second level by each frame period FP when applying the pixel voltages Vd to the pixels 36. Further, the polarity inversion control circuit 50 switches the level of the polarity inversion signal POL in such a manner that a difference between the integrated value of the frame periods FP when the polarity inversion signal POL is in the first level and the integrated value of the frame periods FP when the polarity inversion signal POL is in the second level becomes small. Specifically, the polarity inversion control circuit 50 may be structured as follows.

The polarity inversion control circuit 50 includes: a frame period detection unit 51 which detects the frame periods FP; and a write integrated value calculation unit 52 which, regarding the frame periods FP detected by the frame period detection unit 51, calculates a write integrated value WT that is a difference between the integrated value of the frame periods FP when the polarity inversion signal POL is in the first level and the integrated value of the frame periods FP when the polarity inversion signal POL is in the second level, and switches the level of the polarity inversion signal POL based on the write integrated value WT.

The frame period detection unit 51 detects the frame period FP through inputting a vertical synchronizing signal VSYNC and a reference clock signal DCLK as a clock signal, specifying the frame period FP by two continuous vertical synchronizing signals VSYNC, and counting the reference clock signals DCLK in the specified frame period FP.

The write integrated value calculation unit 52 switches the level of the polarity inversion signal POL when the write integrated value WT reaches an integration threshold value 0. The integration threshold value 0 is a value of zero. At this time, the writing integration value calculation unit 52 calculates the write integrated value WT by taking the frame period FP when the polarity inversion signal POL is in the first level as a positive value (+) and the frame period FP when the polarity inversion signal POL is in the second level as a negative value (−), and switches the level of the polarity inversion signal POL when the write integrated value WT reaches the zero value (0) from the positive side (+) or the negative side (−).

Note that the first level may be set as high level and the second level as low level or the first level may be set as low level and the second level as high level. The reason is that in cases of frame inversion drive the pixel voltages Vd of all the pixels 36 may be inverted from the negative side (−) to the positive side (+) when the write integrated value WT reaches the zero value (0) from the positive side (+) and, on the contrary, the pixel voltages Vd of all the pixels 36 may be inverted from the positive side (+) to the negative side (−) when the write integrated value WT reaches the zero value (0) from the negative side (−).

Further, in cases of dot inversion drive, the pixel voltage Vd is inverted either from the negative side (−) to the positive side (+) or from the positive side (+) to the negative side (−) by each of the pixels 36 when the write integrated value WT reaches the zero value (0) from the positive side (+) and, on the contrary, the pixel voltage Vd is inverted either from the positive side (+) to the negative side (−) or from the negative side (−) to the positive side (+) by each of the pixels 36 when the write integrated value WT reaches the zero value (0) from the negative side (−). Further, in cases of line inversion drive, the pixel voltage Vd is inverted either from the negative side (−) to the positive side (+) or from the positive side (+) to the negative side (−) by each line when the write integrated value WT reaches the zero value (0) from the positive side (+) and, on the contrary, the pixel voltage Vd is inverted either from the positive side (+) to the negative side (−) from the negative side (−) to the positive side (+) by each line when the write integrated value WT reaches the zero value (0) from the negative side (−). Dot inversion drive is a driving method for writing the voltage in such a manner that the polarities of the pixel voltages of dots neighboring to each other vertically or laterally, for example, are inverted. Line inversion drive is a driving method for writing the voltage in such a manner that the polarities of the pixel voltages of lines neighboring to each other are inverted.

Next, the first exemplary embodiment will be described in more details. In the explanations below, an n-th frame after starting input of an image (the n-th frame) is taken as the reference. Further, it is so defined that the first level is high level and the second level is low level, and frame inversion drive is employed.

In other words, the liquid crystal display device 11 includes a display controller 21 and the liquid crystal panel 30. The display controller 21 includes a display control signal generation circuit 40 and the polarity inversion control circuit 50. The liquid crystal panel 30 includes a plurality of pixels 36 and also has a function of continuously inputting data signals "data" of different frame periods FP, applying the pixel voltages Vd corresponding to the data signals "data", and inverting the polarity of the pixel voltage Vd according to the polarity inversion signal POL. The display controller 21 generates the polarity inversion signal POL in such a manner that the time for applying the pixel voltage Vd of positive polarity and the time for applying the pixel voltage Vd of negative polarity become equivalent, and outputs the polarity inversion signal POL to the liquid crystal panel 30.

The concept of a host processor 60 includes the above-described GPU. The data signal "data", the vertical synchronizing signal VSYNC, and the reference clock signal DCLK are outputted from the host processor 60. The data signal "data" is outputted to a source driver 33, the vertical synchronizing signal VSYNC and the reference clock signal DCLK are outputted to the display control signal generation circuit 40, respectively. The data signal "data" may not be directly outputted to the source driver 33 but may be outputted to the source driver 33 via the display control signal generation circuit 40.

The liquid crystal panel 30 includes a gate driver 31, the source driver 33, and a pixel part 35. The pixel part 35 includes a plurality of the pixels 36. In the pixels 36, writing of the image signal (pixel voltage Vd) supplied to a source line 34 from the source driver 33 is controlled by a scan signal supplied to a gate line 32 from the gate driver 31.

The display control signal generation circuit 40 is a circuit which outputs the signals for operating the gate driver 31 and the source driver 33 based on the synchronizing signals inputted from the host processor 60. As the synchronizing signals, there are a horizontal synchronizing signal HSYINC (not shown), the vertical synchronizing signal VSYNC, and the reference clock signal DCLK, for example.

As the signal for operating the gate driver 31, there are a gate-line side start pulse GSP, a gate-line side clock signal GCLK, and the like. Note that the concept of the gate-line side clock signal GCLK includes a plurality of gate-line side clock signals acquired by shifting the phase of the reference clock signal DCLK.

As the signal for operating the source driver 33, there are a source-line side start pulse SSP, a source-line side clock signal SCLK, and the like. Note that the concept of the source-line side clock signal SCLK includes a plurality of source-line side clock signals acquired by shifting the phase of the reference clock signal DCLK.

Further, to the source driver 33, the data signal "data" is supplied from outside and the polarity inversion signal POL is supplied from the polarity inversion control circuit 50, respectively. The source driver 33 converts the data signal "data" to an image signal of analog values based on the polarity inversion signal POL. This conversion may be performed by a circuit that is a combination of a ladder resistance circuit and a switch, for example. It is still better to employ a structure with which y-correction and the like are performed simultaneously.

The circuit in the source driver 33 having this function may be any type of circuit as long as it can inverts the polarity of the image signal outputted to the pixels 36 according to the polarity inversion signal POL inputted. For example, an inverting amplifier for inverting the polarity of the image signal outputted to the pixels 36 may be used.

The polarity inversion signal POL is the signal which determines the image signal to be of higher potential (positive polarity) or lower potential (negative polarity) with respect to the common potential when converting the data signals data to the image signals of analog values.

Figure 2:
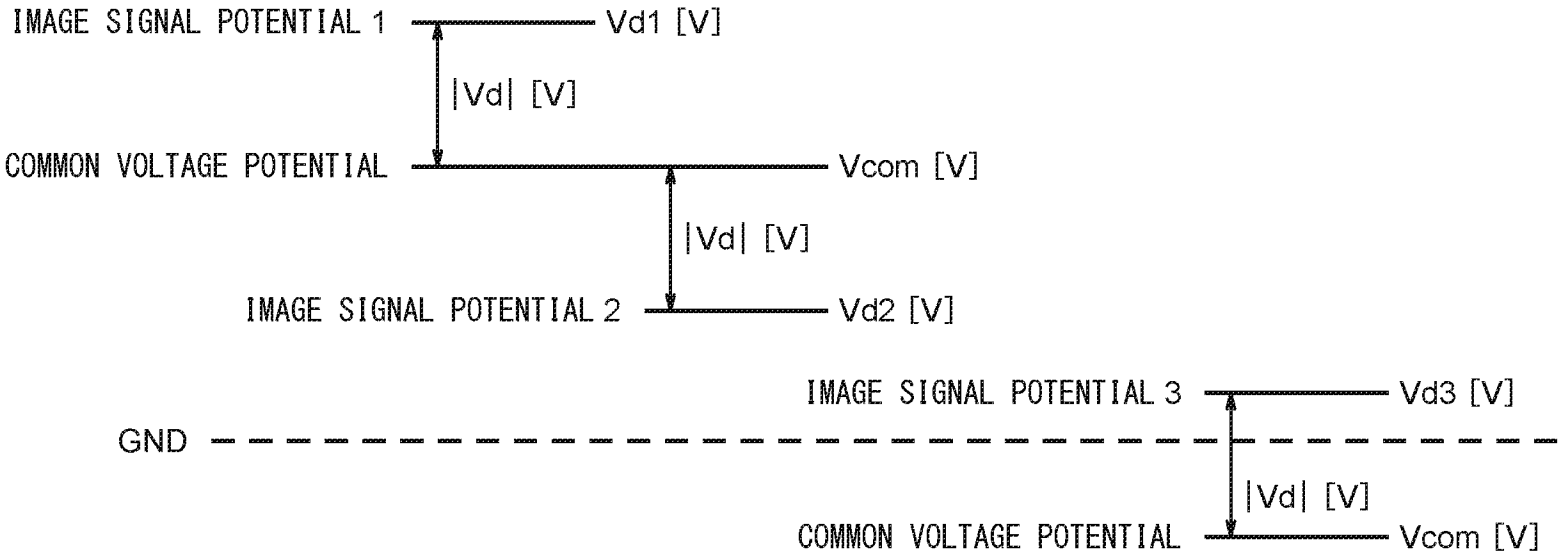
FIG. 2 is an explanatory chart showing a difference between the potential of an image signal and the potential of a common voltage according to the first exemplary embodiment.

The image signal is a potential based on the data signal data. The image signal is constituted with the potential (pixel voltage Vd) applied to one of the electrodes of the liquid crystal element via the source line 34. Application of the image signal to the liquid crystal element is also referred to as writing of the image signal to the pixel 36. When the data signals data inputted to the liquid crystal display device 11 are constant, the absolute values of the differences between the potentials of the image signals and the potentials of the common voltages also become constant. Explanations will be provided by referring to FIG. 2. The potentials Vd1, Vd2, and Vd3 of the image signals in FIG. 2 are different potentials from each other. However, the differences |Vd| between those and the potential of the corresponding common voltage are all constant. Thus, each of the potentials Vd1, Vd2, and Vd3 of the image signals shows the value of the same data signal (pixel voltage Vd).

When the potential of the image signal is higher than the potential of the common voltage, the image signal of positive polarity is applied to the liquid crystal element. Inversely, when the potential of the image signal is lower than the potential of the common voltage, the image signal of negative polarity is applied to the liquid crystal element.

The polarity inversion control circuit 50 is constituted with a frame period detection unit 51, a write integrated value calculation unit 52, and a register 53 that includes a frame period register 54 and a write integrated value register 55.

The frame period detection unit 51 detects the cycle of the vertical synchronizing signals VSYNC inputted from the host processor 60 as the frame period FP, and stores the detected result to the frame period register 54. Note here that the frame period FP is a period where an image of one frame is displayed on the liquid crystal panel 30, which is a reciprocal of fps.

Further, it is to be noted that the frame period FP when the polarity inversion signal POL is high level is treated as a positive (+) numerical value, and the frame period FP when the polarity inversion signal POL is low level is treated as a negative (−) numerical value.

Figure 3:
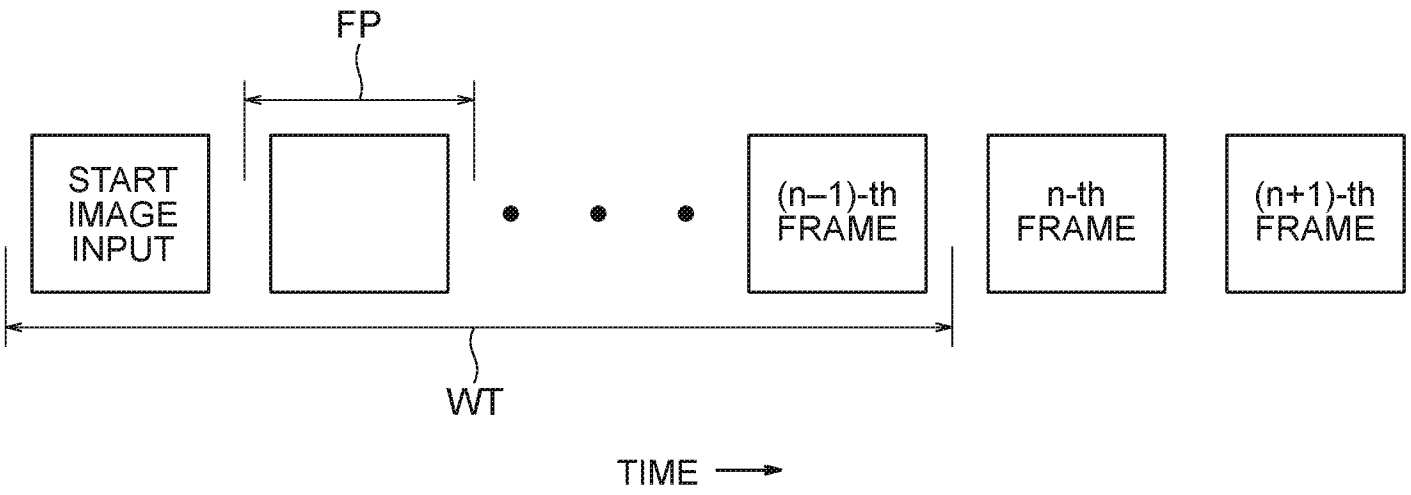
FIG. 3 is an explanatory chart showing a frame period and a write integrated value according to the first exemplary embodiment.

The frame periods FP and the write integrated value WT are shown in FIG. 3. Assuming that the currently writing frame is the n-th frame, the write integrated value calculation unit 52 integrates each of the frame periods FP up to the (n−1)-th frame and stores the value to the write integrated value register 55 as the integrated value WT. Note here that the frame periods FP are integrated as the positive and negative numerical values as described above. For example, the write integrated value WT in a case where fps of the input image is constant becomes 0 (zero) because the number of positive frames and the number of negative frames are offset to be the same number when the (n−1) is an even number, and the last one frame remains so that it becomes equivalent to the frame period FP when the (n−1) is an odd number.

The polarity inversion signal POL is outputted from the write integrated value calculation unit 52. Whether the value of the polarity inversion signal POL is of high level or low level is determined by the sign of the write integrated value WT. That is, the polarity inversion signal POL of high level is outputted when the write integrated value WT is a negative value. In the meantime, when the write integrated value WT is a positive value, the polarity inversion signal POL of low level is outputted. Inversely, it is also possible to employ a structure with which the polarity inversion signal POL of low level is outputted when the write integrated value WT is a negative value while the polarity inversion signal POL of high level is outputted when the write integrated value WT is a positive value.

Next, actions of the liquid crystal display device 11 will be described in details.

Figure 4:
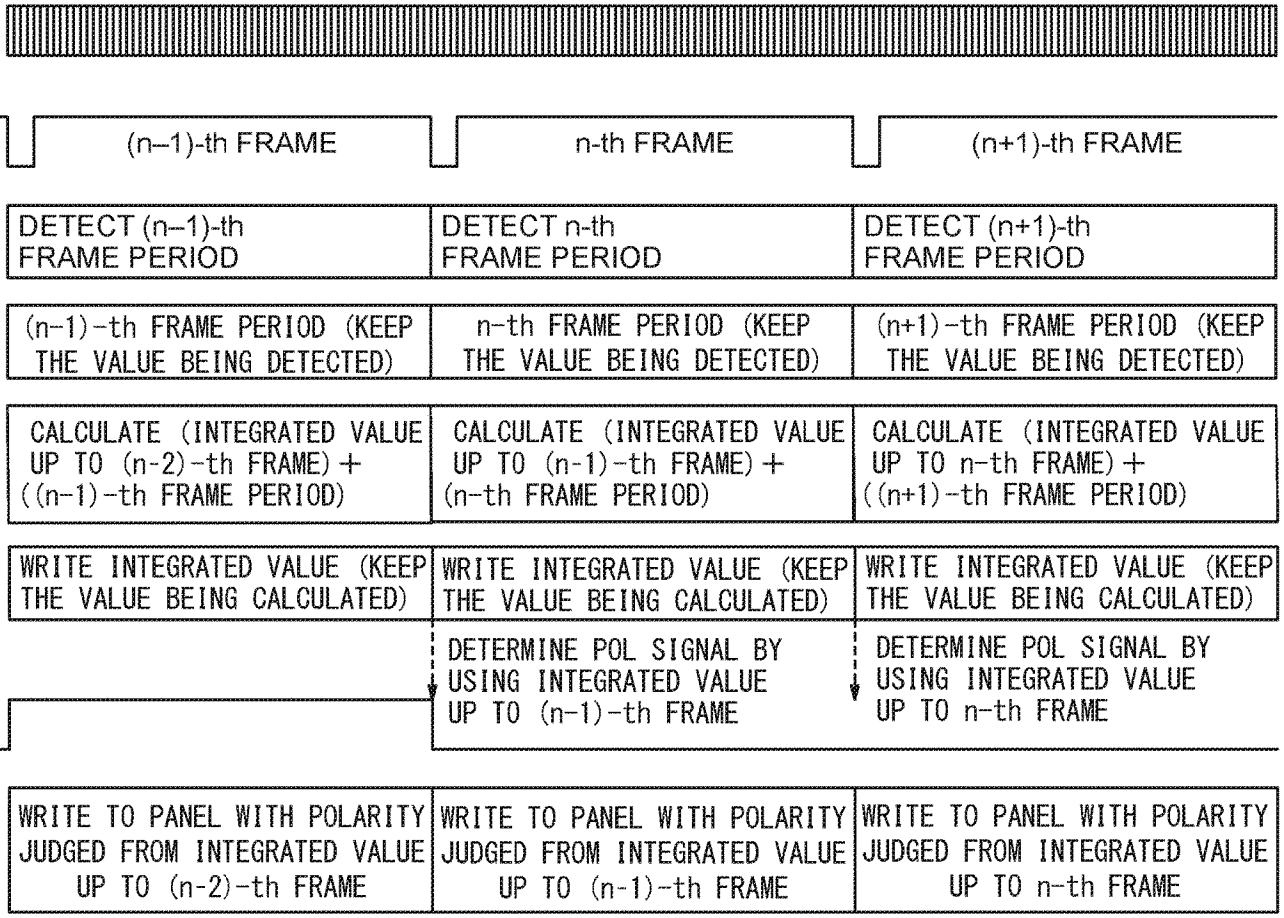
FIG. 4 is a timing chart showing actions of the liquid crystal display device according to the first exemplary embodiment.

FIG. 4 is a timing chart showing the actions of the liquid crystal display device 11. FIG. 4 shows the synchronizing signals (reference clock signal DCLK and vertical synchronizing signal VSYNC), the operations states of the frame period detection unit 51, the values of the frame period register 54, the calculation content of the write integrated value calculation unit 52, the values of the write integrated value register 55, the states of the polarity inversion signal POL, and the write states to the liquid crystal panel 30 in the (n−1)-th frame, the n-th frame, and the (n+1)-th frame.

As described above, the write integrated value calculation unit 52 uses the write integrated value WT to decide whether to set the polarity inversion signal POL to be of high level or low level. Upon receiving the polarity inversion signal POL, the source driver 33 writes to the liquid crystal panel 30 the image signal of the polarity according to that level (high level or low level).

The frame period FP is detected by counting the rise (or fall) of the reference clock signals DCLK inputted in the period from the rise (or fall) of the vertical synchronizing signal VSYNC to the rise (or fall) of the next vertical synchronizing signal VSYNC. Further, the value of the frame period FP that is being detected is sequentially held to the frame period register 54 by taking the rise (or fall) of the reference clock signal DCLK as the reference.

The write integrated value WT is acquired by adding the frame period FP of the n-th frame to the integrated value of each of the frame periods FP up to the (n−1)-th frame. The frame period FP is the value that is sequentially held to the frame period register 54, so that the value of the write integrated value WT is calculated sequentially based on that. The calculation result of the write integrated value WT is sequentially held to the write integrated value register 55 by taking the rise (or fall) of the reference clock signal DCLK as the reference.

As described above, the state of the polarity inversion signal POL is determined according to the value of the write integrated value register 55. For example, the polarity inversion signal POL of high level is outputted when the write integrated value WT held to the write integrated value register 55 is a negative value, and the polarity inversion signal POL of low level is outputted when the write integrated value WT is a positive value.

The write state to the liquid crystal panel 30 is determined according to the output state of the polarity inversion signal POL. For example, writing of a case where the output state of the polarity inversion signal POL is low level is done with a lower potential (negative polarity) with respect to the common voltage while writing of a case where the output state of the polarity inversion signal POL is high level is done with a higher potential (positive polarity) with respect to the common voltage. The above relations can be summarized as "write integrated value WT is positive→polarity inversion signal POL is low level (frame period FP is negative)→writing polarity is negative" and "write integrated value WT is negative→polarity inversion signal POL is high level (frame period FP is positive)→writing polarity is positive".

In other words, "write integrated value" is the integrated value up to the frame that is one before the frame to be written currently and "writing polarity" is the writing polarity of the frame to be written currently. Regarding the expressions "write with positive polarity" and "write with negative polarity", the target pixels vary depending on the inversion driving methods. For example, it is per target pixel in a case of dot inversion drive, per gate line or per data line in a case of line (gate or drain) inversion drive, and per whole pixels in a case of frame inversion drive.

Figure 5:
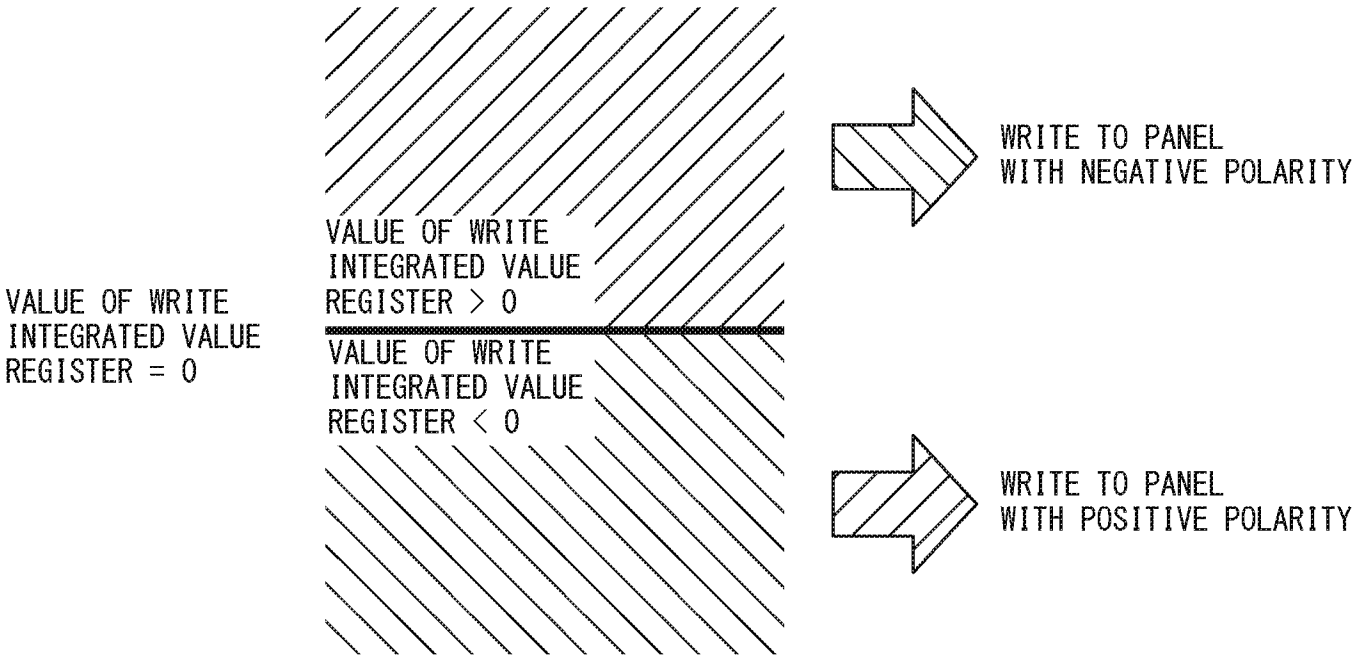
FIG. 5 is an explanatory chart showing the relation between signs of a write integrated value register and the writing polarities to the liquid crystal panel according to the first exemplary embodiment.

The relations between the signs of the values (write integrated values WT) of the write integrated value register 55 of the above-described actions and the writing polarities to the liquid crystal panel 30 are shown in FIG. 5. Describing it as a simple image by taking "value of write integrated value register=0" as the integrated threshold value 0: in the first exemplary embodiment, actions are done to perform writing with negative polarity in a range where "value of write integrated value register>0" and to perform writing with positive polarity in a range where "value of write integrated value register<0".

Note that the polarity inversion signal POL may be of an inverted logic from that of the above-described actions. That is, it may be that the polarity inversion signal POL of low level is outputted when the value held to the write integrated value register 55 is negative, and the polarity inversion signal POL of high level is outputted when the value held to the write integrated value register 55 is positive.

The write state to the liquid crystal panel 30 may also be of an inverted logic from that of the above-described actions. That is, it may be that writing is performed with a lower potential (negative polarity) with respect to the common voltage when the output state of the polarity inversion signal POL is high level, and is performed with a higher potential (positive polarity) with respect to the common voltage when the output state of the polarity inversion signal POL is low level.

Through performing the actions as in the first exemplary embodiment, the image signals can be written to the liquid crystal panel 30 by keeping the fps even when the input fps changes dynamically. Therefore, all the above-described inconveniences (1), (2), and (3) can be suppressed, and deviation of the charging polarity to the liquid crystal panel 30 can be prevented as well.

Figure 6:
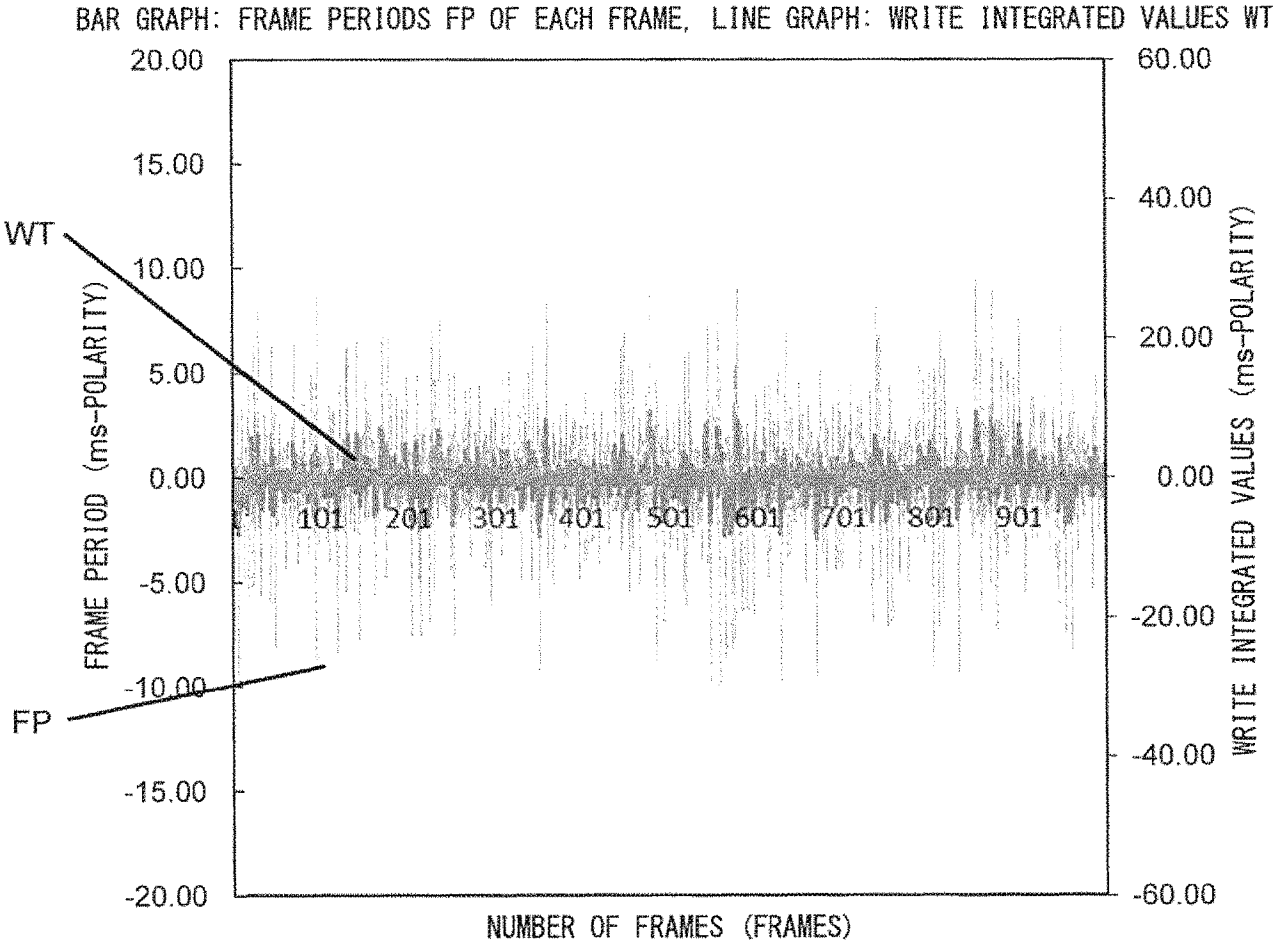
FIG. 6 is a graph showing the relation regarding the number of frames, the frame periods, and the write integrated values according to the first exemplary embodiment.
Figure 7:
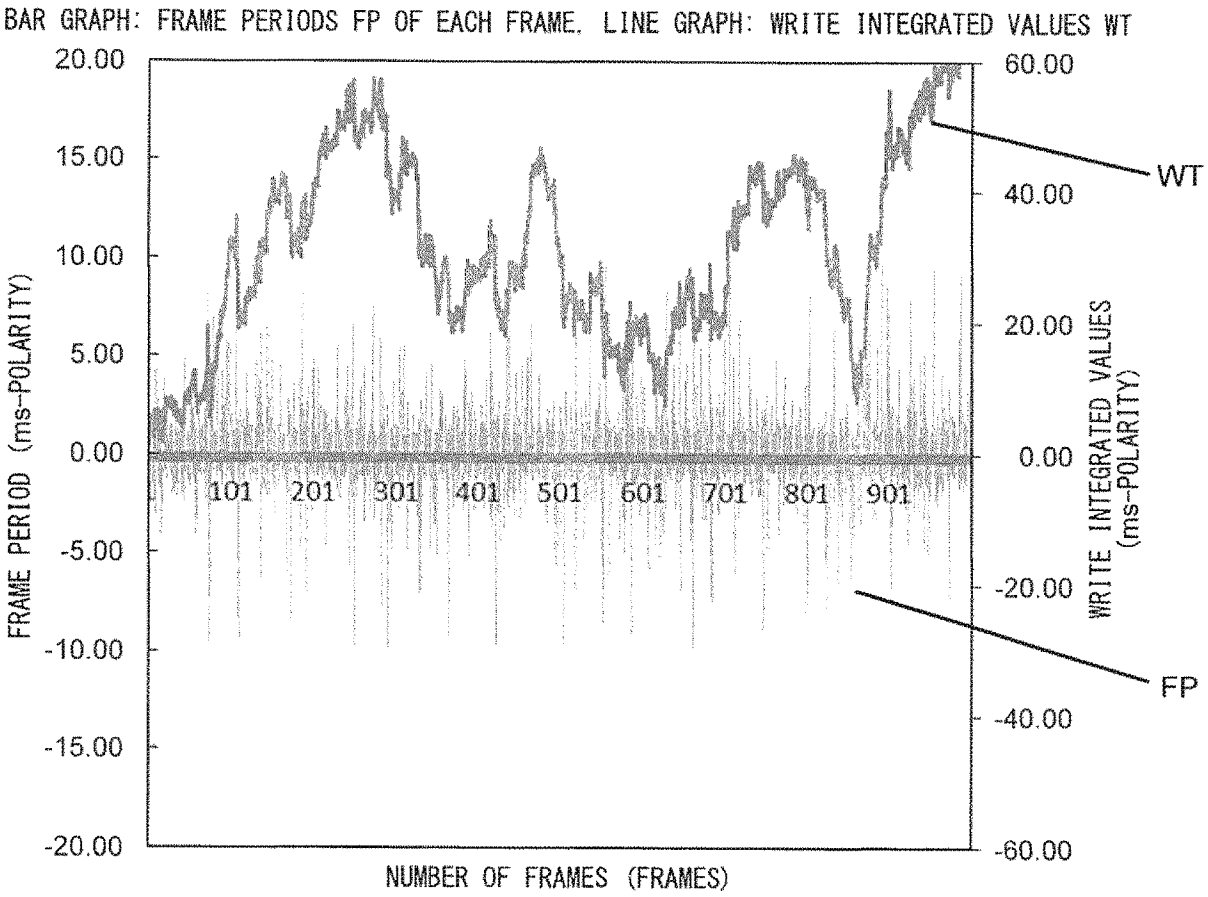
FIG. 7 is a graph showing the relation regarding the number of frames, the frame periods, and the write integrated values according to a comparative example.

Regarding the relations between the number of frames, the frame periods, and the write integrated values, FIG. 6 shows a graph of the first exemplary embodiment and FIG. 7 shows a graph of Comparative Example. In each graph, the lateral axis shows the number of written frames. The left vertical axis shows the frame period FP of each frame, and the frame period FP corresponds to the bar graph. The right vertical axis shows the write integrated value WT, and the write integrated value WT corresponds to the line graph. In the Comparative Example of FIG. 7, the writing polarity is inverted alternately by each frame as in the case of Related Technique 2.

As can be seen from FIG. 6 and FIG. 7, it is found that there is less deviation of the wiring integrated values WT in the first exemplary embodiment compared to that of the Comparative Example. That is, the first exemplary embodiment makes it possible to achieve an effect of suppressing the deviation of the charging polarity to the liquid crystal panel 30.

Limiting to the point that the deviation of the charging polarity to the liquid crystal panel 30 can be suppressed, it is equivalent to the case of using double-speed drive shown in Patent Document 1. However, in order to acquire such effect, the circuit structure of the first exemplary embodiment requires only the "control circuit" while Patent Document 1 requires the circuit structures such as the "field memory", the "synchronizing/separating circuit", the "control circuit" and the like. That is, the first exemplary embodiment is capable of suppressing the above-described inconveniences (1), (2), and (3) with the smaller-scale circuit than that of the double-speed drive and also capable of suppressing the deviation of the charging polarity to the liquid crystal panel 30. Therefore, deterioration of the liquid crystal panel 30 can be prevented.

Further, with Patent Document 1, writing to the liquid crystal panel is performed at a double-speed of the input fps. Thus, about the twice the power is required to be consumed compared to the case of a typical liquid crystal display device. In the meantime, with the first exemplary embodiment, writing to the liquid crystal panel is performed at the same speed as the input fps or slower. Thus, the increase amount of the power consumption can be suppressed to be smaller than the case of Patent Document 1.

As described, through generating the polarity inversion signal POL in such a manner that the time for applying the pixel voltage Vd of positive polarity and the time for applying the pixel voltage Vd of negative polarity become equivalent, the first exemplary embodiment makes it possible to achieve the writing polarity of each frame with no deviation of the charging polarity while suppressing an increase in the number of members since it is unnecessary to add a memory device and the like and also suppressing an increase in the power consumption since polarity inversion at a double-speed is unnecessary. Therefore, ghosting of the liquid crystal panel 30 can be prevented.

The polarity inversion control device according to the first exemplary embodiment is provided as the polarity inversion control circuit 50 inside the display controller 21. However, it may be provided on the liquid crystal panel 30 side or on the host processor 60 side.

A liquid crystal display device driving method according to the first exemplary embodiment is the actions of the polarity inversion control circuit 50 taken as a method invention. That is, the driving method according to the first exemplary embodiment is a method for driving the liquid crystal display device 11 provided with the liquid crystal panel 30, which is characterized to: detect the frame period FP; regarding the detected frame period FP, switch the level of the polarity inversion signal POL in such a manner that the difference between the integrated value of the frame periods FP when the polarity inversion signal POL is in the first level and the integrated value of the frame periods FP when the polarity inversion signal POL is in the second level becomes small; and supply the switched polarity inversion signal POL to the liquid crystal panel 30.

A liquid crystal display device driving program according to the first exemplary embodiment is the actions of the polarity inversion control circuit 50 taken as a program invention. That is, the driving program according to the first exemplary embodiment is for driving the liquid crystal display device 11 provided with the liquid crystal panel 30 and causing a computer to execute: a procedure for detecting the frame period FP; a procedure for, regarding the detected frame period FP, switching the level of the polarity inversion signal POL in such a manner that the difference between the integrated value of the frame periods FP when the polarity inversion signal POL is in the first level and the integrated value of the frame periods FP when the polarity inversion signal POL is in the second level becomes small; and a procedure for supplying the switched polarity inversion signal to the liquid crystal panel 30. Examples of such computer may be FPGA, DSP (digital signal processor), and the like. This program may be recorded on a non-transitory storage medium such as an optical disk, a semiconductor memory, or the like. In that case, the program is read out from the storage medium by the computer and executed.

Other structures of the driving method and the driving program of the first exemplary embodiment conform to the structures of the polarity inversion control device of the first exemplary embodiment.

Next, Example that is a more concrete form of the first exemplary embodiment will be described.

Figure 8A:
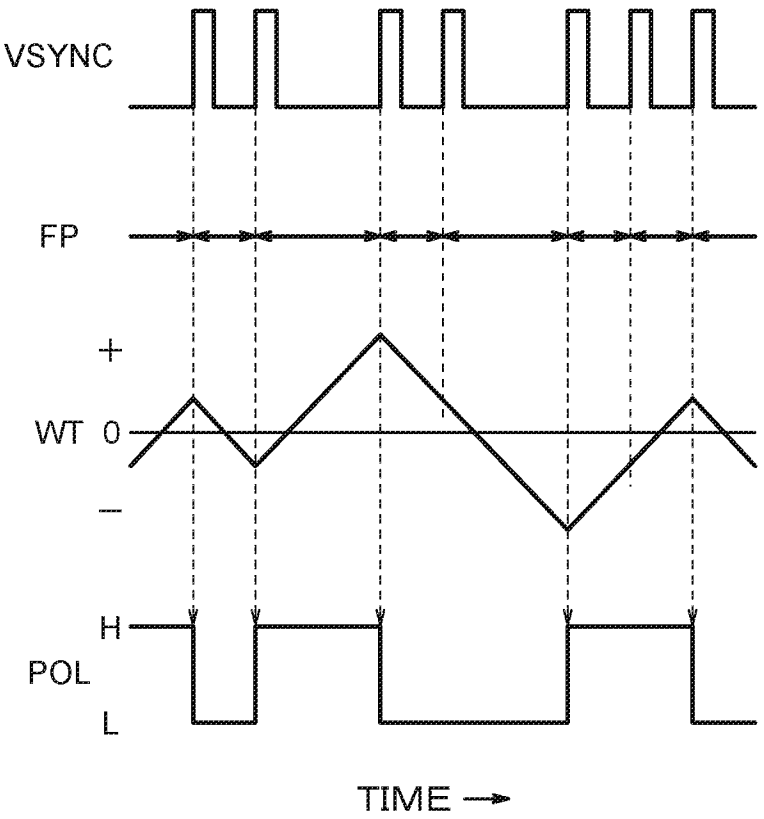
FIG. 8A is a timing chart showing a vertical synchronizing signal, a frame period, a write integrated value, and a polarity inversion signal according to an Example of the first exemplary embodiment.
Figure 9A:
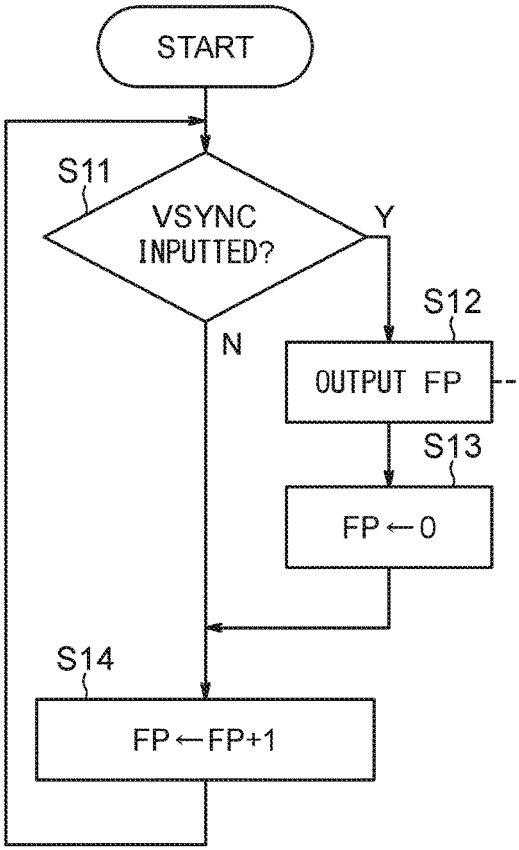
FIG. 9A is a flowchart showing actions of a frame period detection unit according to the Example of the first exemplary embodiment.
Figure 9B:
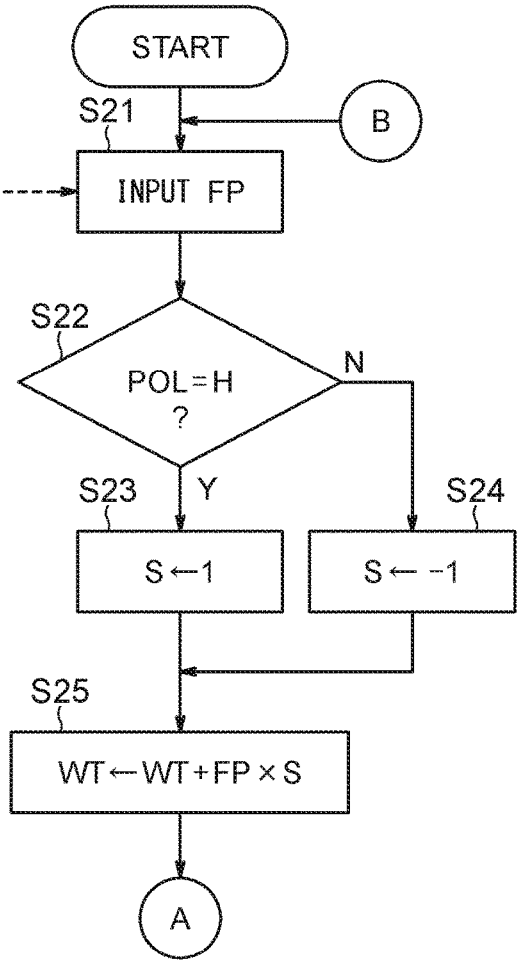
FIG. 9B is a flowchart showing a first half of the actions of a write integrated value calculation unit according to the Example of the first exemplary embodiment.
Figure 10:
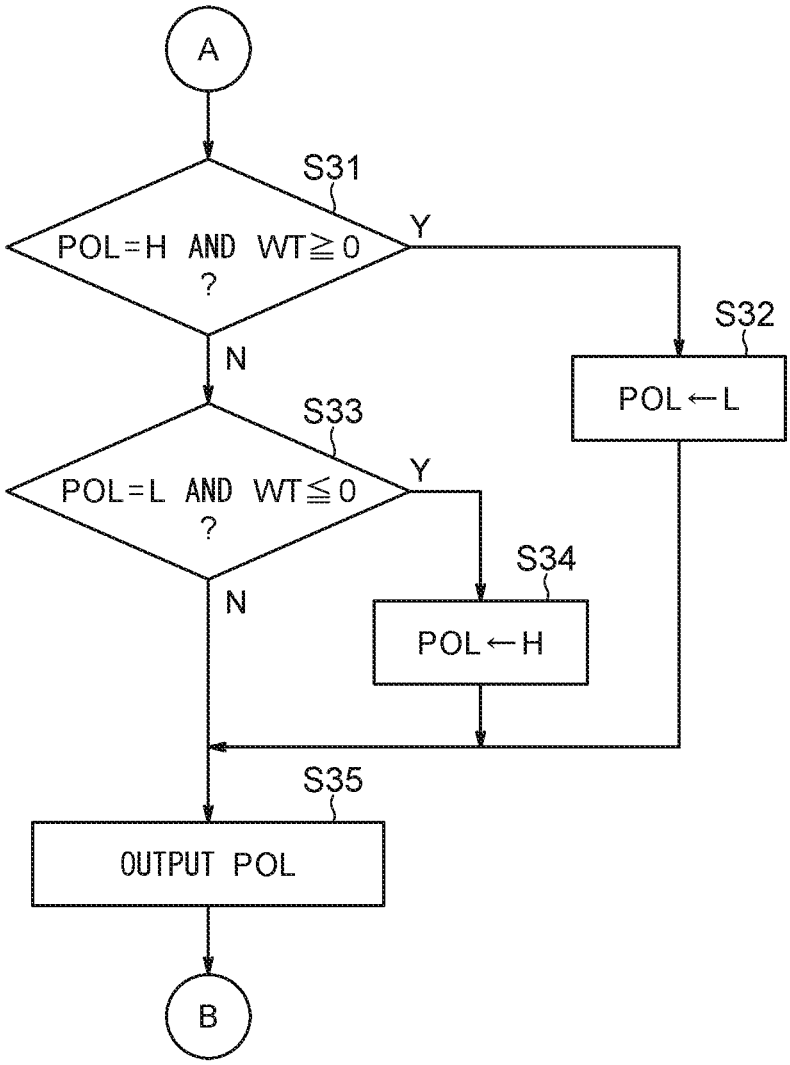
FIG. 10 is a flowchart showing a latter half of the actions of the write integrated value calculation unit according to the Example of the first exemplary embodiment.

FIG. 8A, FIG. 9A, FIG. 9B, and FIG. 10 show Example of the first exemplary embodiment. FIG. 8A is a timing chart showing vertical synchronizing signal VSYNC, a frame period FP, a write integrated value WT, and a polarity inversion signal POL. FIG. 9A is a flowchart showing actions of a frame period detection unit. FIG. 9B is a flowchart showing a first half of the actions of the write integrated value calculation unit. FIG. 10 is a flowchart showing a latter half of the actions of the write integrated value calculation unit. Hereinafter, more detailed explanations will be provided by adding those drawings to FIG. 1.

An example of the actions of the frame period detection unit 51 will be described by referring to FIG. 1, FIG. 8A, and FIG. 9A. As shown in FIG. 8A, the vertical synchronizing signals VSYNC are outputted intermittently from the host processor 60. At that time, the frame period detection unit 51 operates as follows. First, the frame period detection unit 51 judges whether or not the vertical synchronizing signal VSYNC is inputted (step S11), writes the detected frame period FP to the frame period register 54 when judged that the vertical synchronizing signal VSYNC is inputted (step S12), and resets the frame period FP to "0" (step S13). When judged that the vertical synchronizing signal VSYNC is not inputted or the frame period FP is reset to "0", the frame period detection unit 51 adds "1" to the frame period FP and returns to step S11. This "1" corresponds to the unit time acquired from the reference clock signal DCLK. That is, like the vertical synchronizing signal VSYNC and the frame period FP shown in FIG. 8A, the frame period detection unit 51 detects the frame period FP from the vertical synchronizing signal VSYNC.

A first half of the action of the write integrated value calculation unit 52 will be described by referring to FIG. 1, FIG. 8A, and FIG. 9B. The write integrated value calculation unit 52 operates as follows. The write integrated value calculation unit 52 reads out, from the frame period register 54, the frame period FP written to the frame period register 54 from the frame period detection unit 51 by the n-th vertical synchronizing signal VSYNC by taking the n-th vertical synchronizing signal VSYNC, for example, as a trigger (step S21). Then, the write integrated value calculation unit 52 judges whether or not the currently outputting polarity inversion signal POL is high level (step S22). When judged that the polarity inversion signal POL is high level, the sign S is set as "1" (step S23). Since the polarity inversion signal POL is low when judged that it is not high level, the sign S is set as "−1" (step S24). Then, the write integrated value calculation unit 52 reads out the write integrated value WT from the write integrated value register 55, acquires a new integrated value WT by using an arithmetic calculation formula "WT←WT+FP×S", and writes the new write integrated value WT to the write integrated value register 55 (step S25). Like the write integrated value WT shown in FIG. 8A, the write integrated value calculation unit 52 calculates the write integrated value WT that is a difference between the integrated value of the frame periods FP when the polarity inversion signal POL is high level and the integrated value of the frame periods FP when the polarity inversion signal POL is low level.

A latter half of the action of the write integrated value calculation unit 52 will be described by referring to FIG. 1, FIG. 8A, and FIG. 10. The write integrated value calculation unit 52 subsequently operates as follows. First, the write integrated value calculation unit 52 reads out the write integrated value WT from the write integrated value register 55 and judges whether or not the polarity inversion signal POL that is being outputted is high level and whether or not the write integrated value WT is 0 or larger (step S31). When the polarity inversion signal POL that is being outputted is high level and the write integrated value WT is 0 or larger, it means that the write integrated value WT has reached the integrated threshold value 0 from the negative side. Thus, the write integrated value calculation unit 52 switches the polarity inversion signal POL from high level to low level (step S32). When the polarity inversion signal POL is not high level and the write integrated value WT is not 0 or larger, the write integrated value calculation unit 52 judges whether or not the polarity inversion signal POL is low level and whether or not the write integrated value WT is 0 or smaller (step S33). When the polarity inversion signal POL that is being outputted is low level and the write integrated value WT is 0 or smaller, it means that the write integrated value WT has reached the integrated threshold value 0 from the positive side. Thus, the write integrated value calculation unit 52 switches the polarity inversion signal POL from low level to high level (step S34). When the polarity inversion signal POL is not low level and the write integrated value WT is not 0 or smaller, it means that the write integrated value WT has not reached the integrated threshold value 0. Thus, the polarity inversion signal POL is not switched but remained as it is. Finally, the write integrated value calculation unit 52 outputs the switched or remained polarity inversion signal POL (step S35). Like the write integrated value WT and the polarity inversion signal POL shown in FIG. 8A, the write integrated value calculation unit 52 switches the level of the polarity inversion signal POL when the write integrated value WT reaches the zero value (0) from the positive side (+) or the negative side (−).

Note that there is a time lag of some extent from the input of the vertical synchronizing signal VSYNC done in step S11 of FIG. 9A to the output of the polarity inversion signal POL done in step S35 of FIG. 10. However, the value thereof is very small so that the input of the vertical synchronizing signal VSYNC and the output of the polarity inversion signal POL are illustrated as simultaneous. Further, in the initial values of the start of the action the frame period FP and the write integrated value WT are defined as "0", respectively, and the polarity inversion signal POL is defined as high level. In FIG. 10, it is described that steps S31, S32 are executed first and steps S33, S34 are executed later. However, inversely, steps S33, S34 may be executed first and steps S31, S32 may be executed later.

Further, it is also possible to create a driving program of the first exemplary embodiment by following the flowcharts of FIG. 9A, FIG. 9B, and FIG. 10. Furthermore, through expressing the flowcharts of FIG. 9A, FIG. 9B, and FIG. 10 with a hardware description language (HDL), it is possible to design the polarity inversion control circuit 50 of the first exemplary embodiment.

Second Exemplary Embodiment

Figure 11:
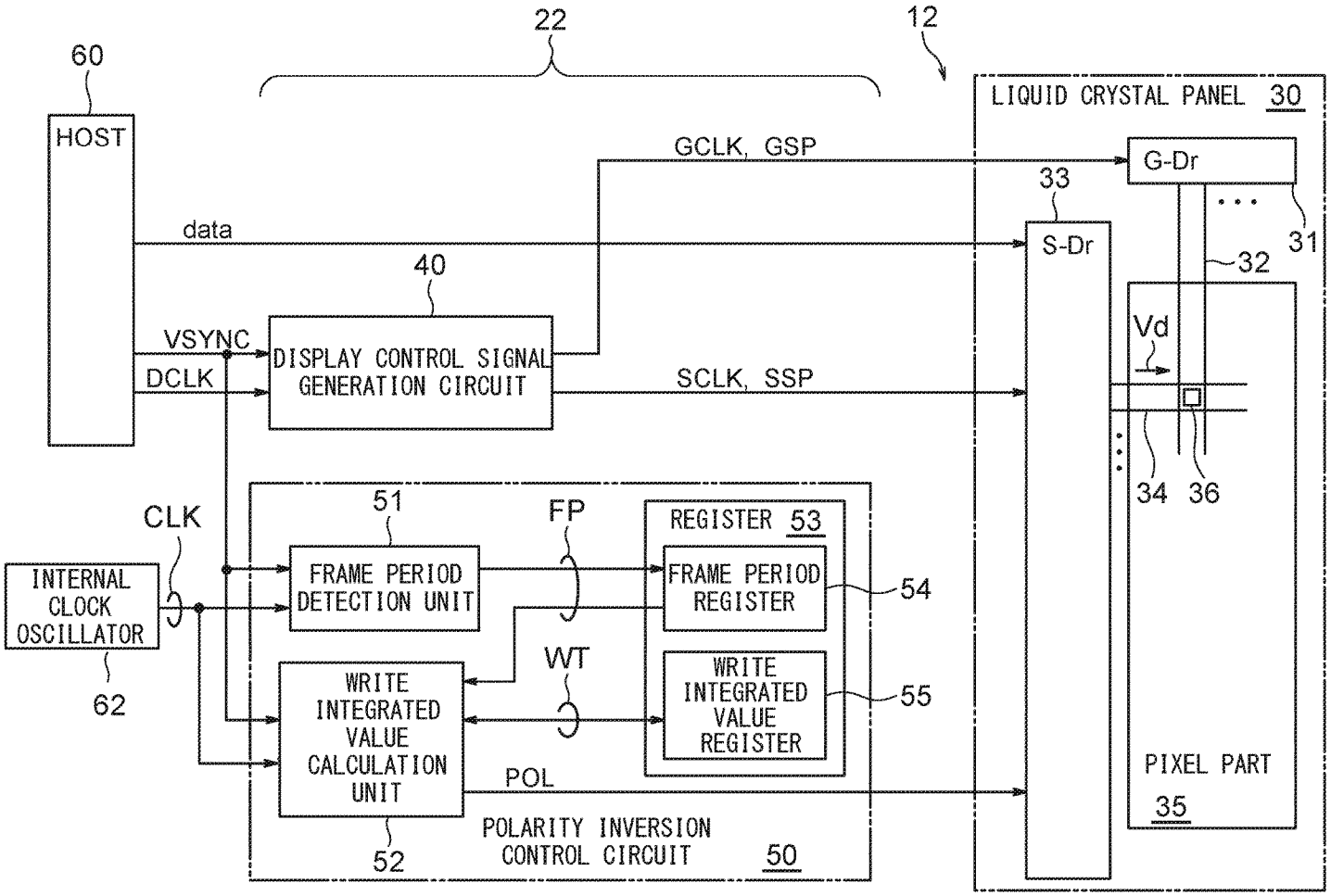
FIG. 11 is a block diagram showing the structures of a liquid crystal display device according to a second exemplary embodiment.

Next, a liquid crystal display device according to a second exemplary embodiment will be described. FIG. 11 is a block diagram showing the structures of the liquid crystal display device according to the second exemplary embodiment.

A liquid crystal display device 12 according to the second exemplary embodiment further includes an internal clock oscillator 62 as a clock signal generation unit for generating internal clock signals CLK as the clock signals. More specifically, employed is a structure with which a display controller 22 includes the internal clock oscillator 62 loaded thereto so that the frame period detection unit 51 and the write integrated value calculation unit 52 do not input the reference clock signal DCLK but the internal clock signal CLK is inputted from the internal clock oscillator 62. That is, the internal clock signal CLK substitutes the function of the reference clock signal DCLK in detecting the frame period. The internal clock oscillator 62 is constituted with a crystal oscillator, its oscillation circuit, and the like, for example. Other structures of the polarity inversion control device, the liquid crystal display device, and the driving method as well as the driving program thereof according to the second exemplary embodiment are the same as those of the first exemplary embodiment.

Figure 12:
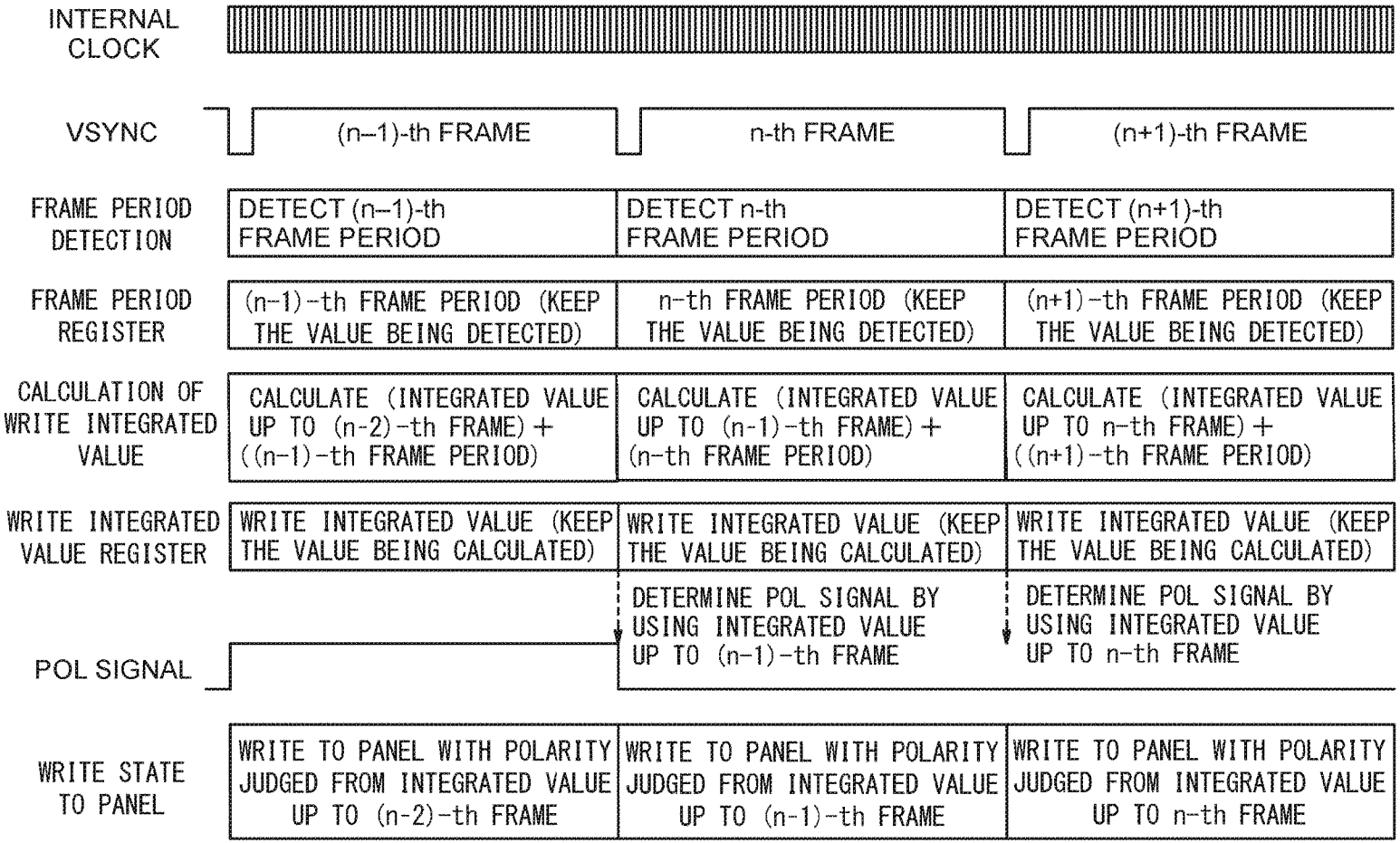
FIG. 12 is a timing chart showing actions of the liquid crystal display device according to the second exemplary embodiment.

FIG. 12 shows a timing chart for describing the actions of the second exemplary embodiment. The actions are same as those of the first exemplary embodiment except for the point that the reference clock signal is replaced with the internal clock signal.

With the second exemplary embodiment, the internal clock signal CLK can be used instead even in a case where the reference clock signal DCLK cannot be inputted to the polarity inversion control circuit 50 from outside. Therefore, the same operations and effects as those of the first exemplary embodiment can be achieved.

Third Exemplary Embodiment

Figure 13:
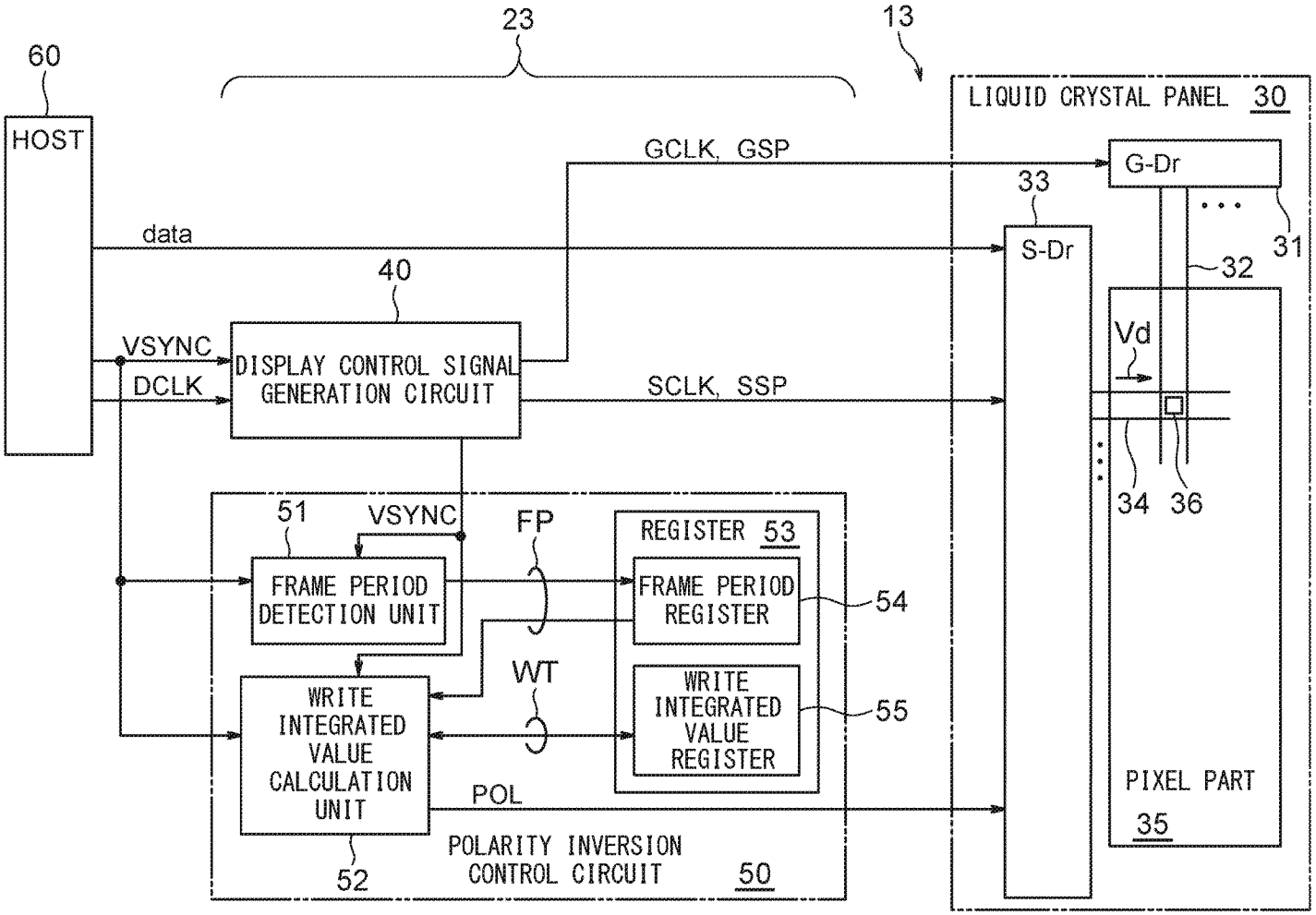
FIG. 13 is a block diagram showing the structures of a liquid crystal display device according to a third exemplary embodiment.

Next, a liquid crystal display device according to a third exemplary embodiment will be described. FIG. 13 is a block diagram showing the structures of the liquid crystal display device according to the third exemplary embodiment.

With a liquid crystal display device 13 according to the third exemplary embodiment, the vertical synchronizing signal VSYNC is not directly inputted from the host processor 60 side to the frame period detection unit 51 and the write integrated value calculation unit 52 of the display controller 23 but inputted via the display control signal generation circuit 40. Other structures of the polarity inversion control device, the liquid crystal display device, and the driving method as well as the driving program thereof according to the third exemplary embodiment are the same as those of the first exemplary embodiment.

Even in a case where the vertical synchronizing signal VSYNC cannot be inputted from outside, the polarity inversion control circuit 50 can input the vertical synchronizing signal VSYNC from the display control signal generation circuit 40. Therefore, the third exemplary embodiment can provide same operations and effects as those of the first exemplary embodiment.

Fourth Exemplary Embodiment

Figure 14:
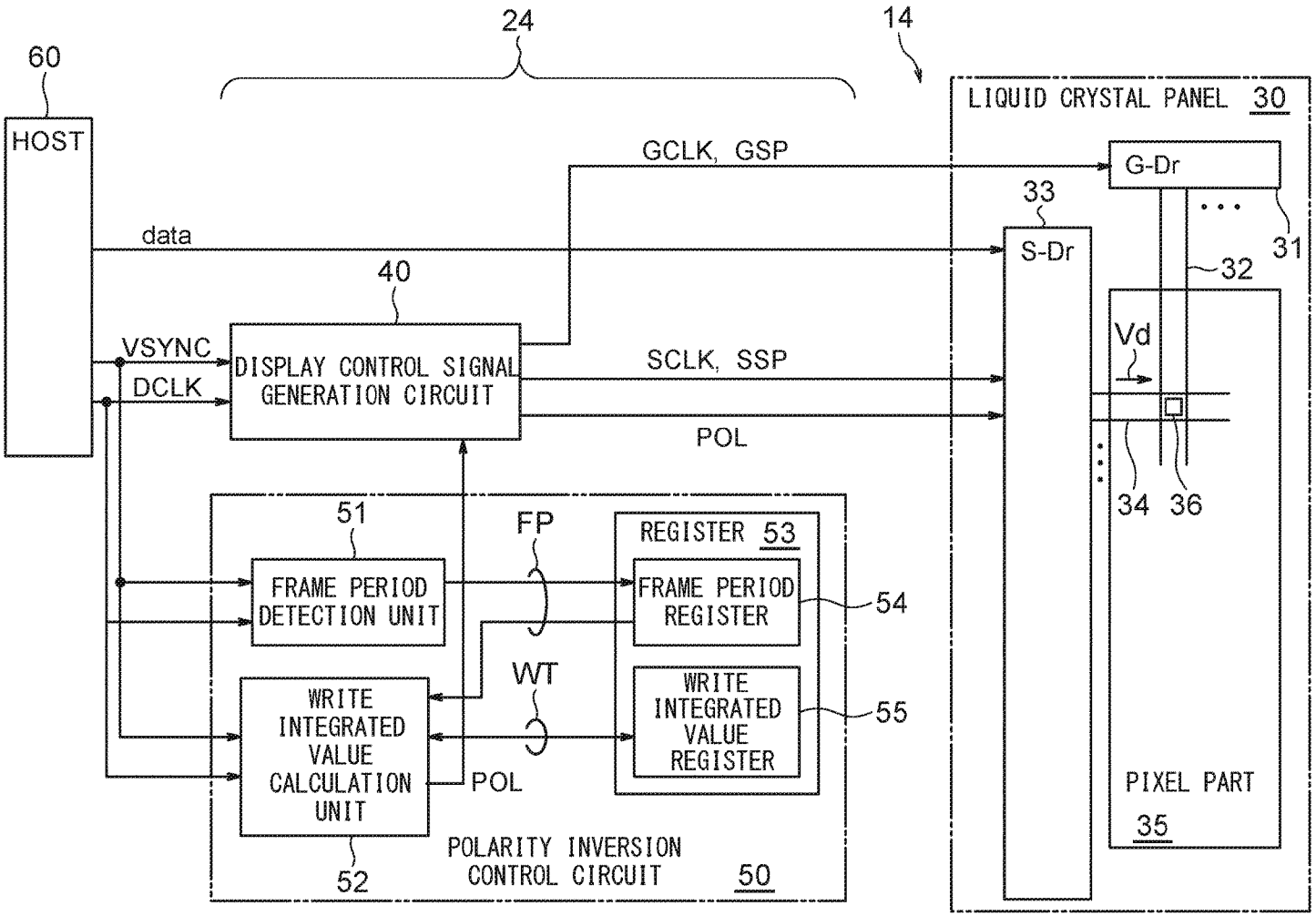
FIG. 14 is a block diagram showing the structures of a liquid crystal display device according to a fourth exemplary embodiment.

Next, a liquid crystal display device according to a fourth exemplary embodiment will be described. FIG. 14 is a block diagram showing the structures of the liquid crystal display device according to the fourth exemplary embodiment.

The polarity inversion signal POL in a liquid crystal display device 14 according to the fourth exemplary embodiment is not directly outputted to the source driver from the write integrated value calculation unit 52 but outputted to the source driver 33 from the write integrated value calculation unit 52 via the display control signal generation circuit 40. Other structures of the polarity inversion control device, the liquid crystal display device, and the driving method as well as the driving program thereof according to the fourth exemplary embodiment are the same as those of the first exemplary embodiment.

Even in a case where the polarity inversion signal POL cannot be outputted directly to the source driver 33, the polarity inversion control signal 50 can output the polarity inversion signal POL to the source driver 33 via the display control signal generation circuit 40. Therefore, the fourth exemplary embodiment can provide same operations and effects as those of the first exemplary embodiment.

Fifth Exemplary Embodiment

Figure 15:
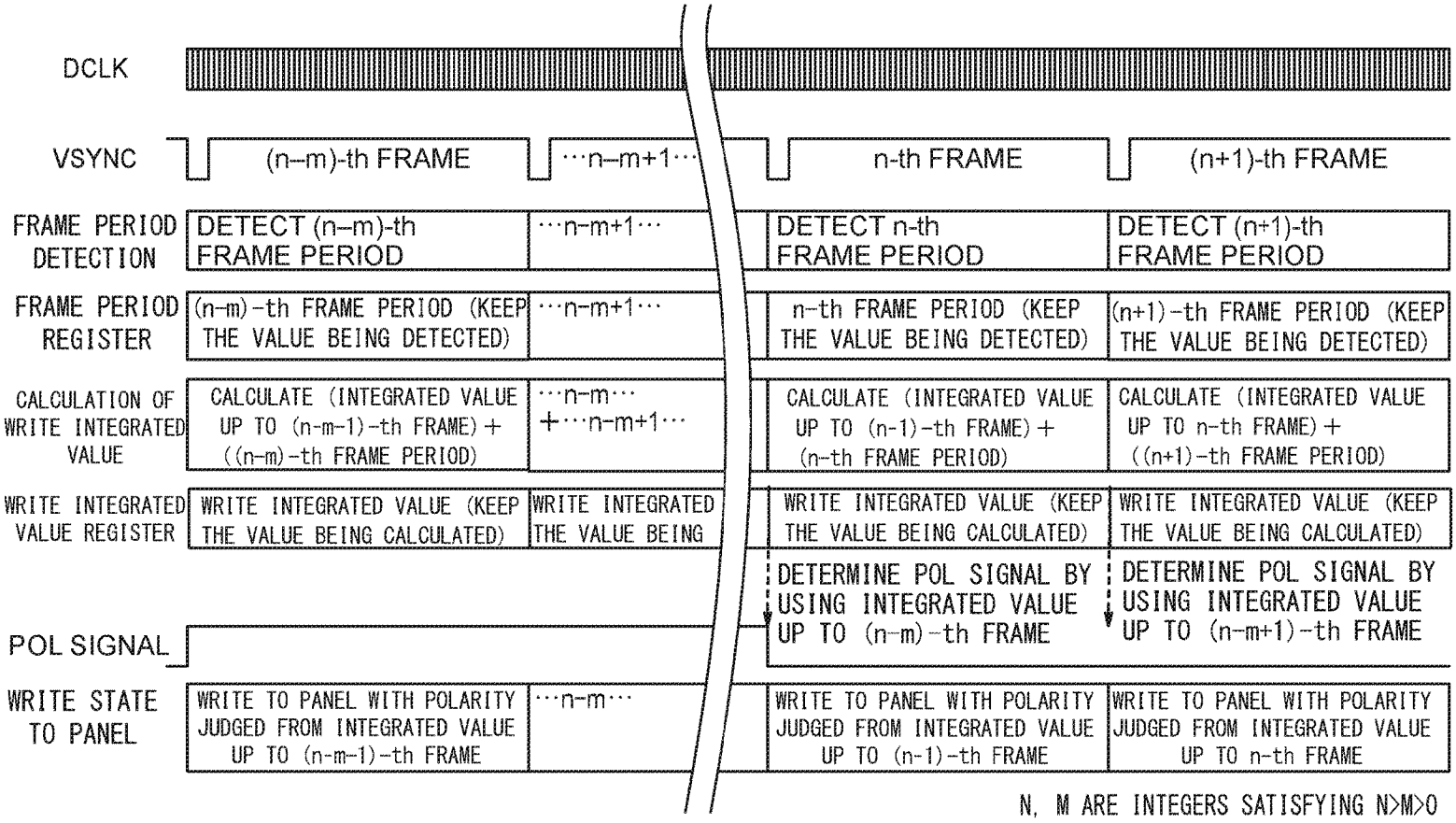
FIG. 15 is a timing chart showing actions of the liquid crystal display device according to a fifth exemplary embodiment.

Next, a liquid crystal display device according to a fifth exemplary embodiment will be described. FIG. 15 is a timing chart showing the actions of the liquid crystal display device according to the fifth exemplary embodiment.

With the liquid crystal display device according to the fifth exemplary embodiment, the timing for switching the polarity inversion signal POL is delayed. More specifically, in the fifth exemplary embedment, the write integrated value WT used for switching the polarity inversion signal POL is not defined as "(integrated value of each frame period FP up to the (n−1)-th frame)+(frame period of the n-th frame)" but defined as "(integrated value of each frame period FP up to the (n−m)-th frame)+(frame period FP of the (n−m+1)-th frame)". Note here that n and m are integers satisfying n>m>0. For delaying the timing, the time itself may be delayed such as delaying for several milliseconds, for example. Alternatively, the timing may be delayed by the number of frames such as delaying for several frames. With the fifth exemplary embodiment, even the write integrated value WT in an arbitrary period before a certain point can be used for judging the polarity inversion signal POL.

Next, a more concrete Example of the fifth exemplary embodiment will be described.

Figure 16A:
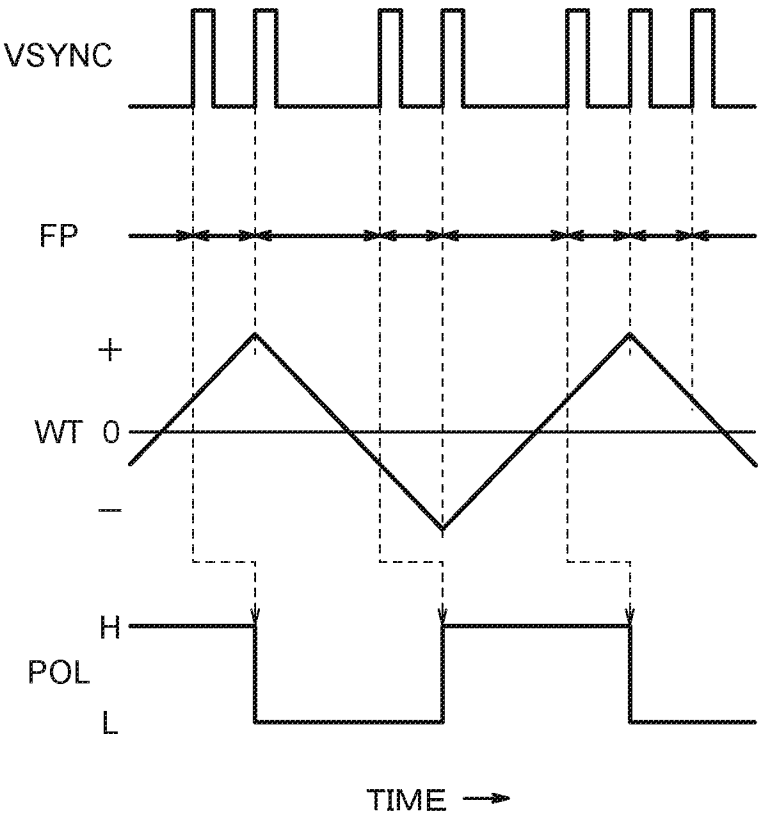
FIG. 16A is a timing chart showing a vertical synchronizing signal, a frame period, a write integrated value, and a polarity inversion signal according to Example of the fifth exemplary embodiment.

FIG. 16A is a timing chart showing a vertical synchronizing signal, a frame period, a write integrated value, and a polarity inversion signal according to the fifth exemplary embodiment. This Example is a case where m=2, i.e., a case where the timing for switching the polarity inversion signal POL is delayed for one frame.

In Example shown in FIG. 16A, the polarity inversion signal POL is transited from low level to high level at the rise of the (n+2)-th frame period in a case where the write integrated value WT reaches the integrated threshold value 0 from the positive side (+) in the n-th frame period FP. Inversely, the polarity inversion signal POL is transited from high level to low level at the rise of the (n+2)-th frame period in a case where the write integrated value WT reaches the integrated threshold value 0 from the negative side (−) in the n-th frame period FP.

Figure 17A:
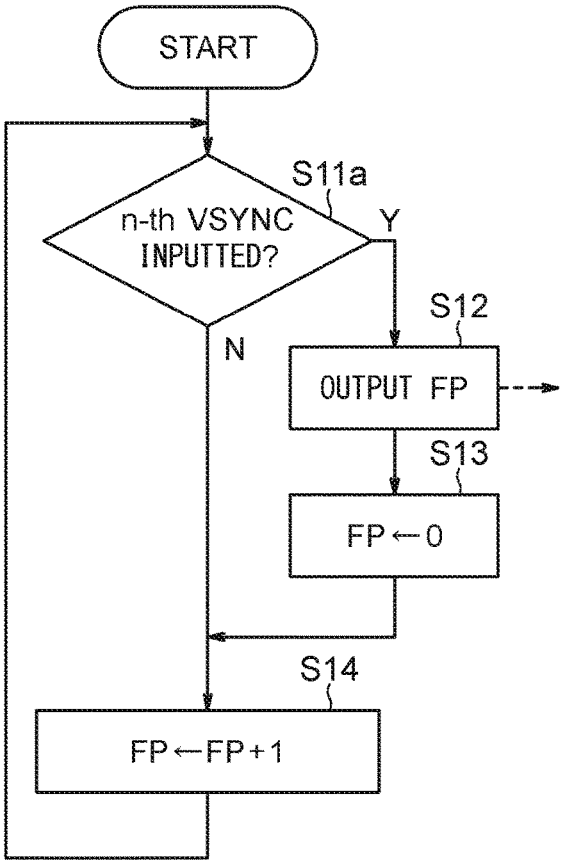
FIG. 17A is a flowchart showing actions of a frame period detection unit according to the Example of the fifth exemplary embodiment.
Figure 17B:
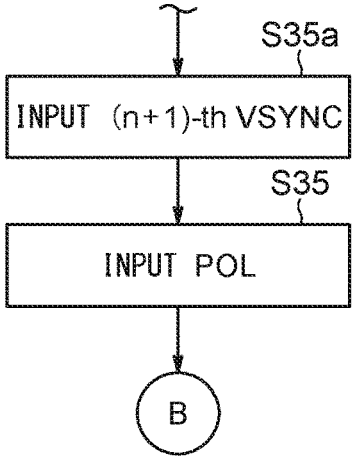
FIG. 17B is a flowchart showing a latter half (a part) of the actions of a write integrated value calculation unit according to the Example of the fifth exemplary embodiment.

FIG. 17A is a flowchart showing actions of the frame period detection unit according to Example of the fifth exemplary embodiment. FIG. 17B is a flowchart showing a latter half (a part) of the actions of the write integrated value calculation unit according to the Example of the fifth exemplary embodiment. FIG. 17A shows a point that "step S11 which judges whether or not the vertical synchronizing signal VSYNC is inputted" in FIG. 9A is replaced with "step S11*a* which judges whether or not the n-th vertical synchronizing signal VSYNC is inputted". FIG. 17B shows a point that "step S35*a* which inputs the (n+1)-th vertical synchronizing signal VSYNC" is inserted before "step S35 which outputs the polarity inversion signal POL" in FIG. 10. Other steps S are the same as those of the first exemplary embodiment shown in FIG. 9A, FIG. 9B and FIG. 10.

In Example of FIG. 16A and the first exemplary embodiment of FIG. 8A, the vertical synchronizing signals VSYNC and the frame periods FP are the same. While the time where polarity inversion signals POL become high level H and the time where the signals POL become low level L are equivalent both in the Example of FIG. 16A and the first exemplary embodiment of FIG. 8A, the switching frequency of the polarity inversion signal POL is less in the Example of FIG. 16A. It is because the absolute value of the write integrated value WT becomes increased for one frame when the timing for switching the polarity inversion signal POL is delayed for one frame, so that the time for reaching the integrated threshold value 0 becomes extended.

Therefore, with the Example, it is possible to decrease the switching frequency of the polarity inversion signal POL so that inversion of the writing polarity can be decreased, thereby making it possible to save the power. Further, there is a sufficient time lag (for one frame) from "step S11*a* which judges whether or not the n-th vertical synchronizing signal VSYNC is inputted" in FIG. 17A to "step S35 which outputs the polarity inversion signal POL" in FIG. 17B, so that there is such an advantage that speedup is not demanded in that respect.

Other structures of the polarity inversion control device, the liquid crystal display device, and the driving method as well as the driving program thereof according to the fifth exemplary embodiment are the same as those of the first exemplary embodiment.

Sixth Exemplary Embodiment

Figure 18:
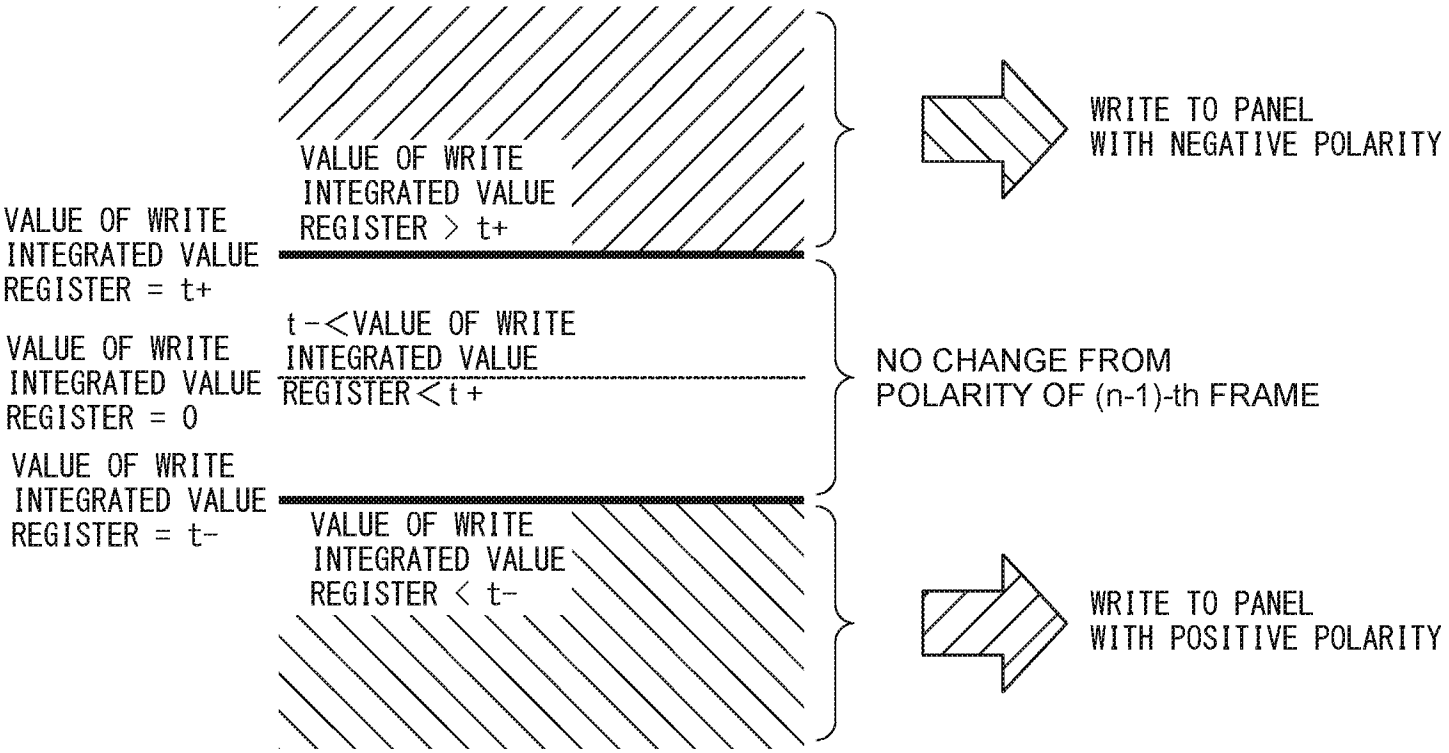
FIG. 18 is an explanatory chart showing the relation between signs of a write integrated value register and the writing polarities to the liquid crystal panel according to the sixth exemplary embodiment.

Next, a liquid crystal display device according to a sixth exemplary embodiment will be described. FIG. 18 is an explanatory chart showing the relation between signs of a write integrated value register and the polarities for writing to the liquid crystal panel according to the sixth exemplary embodiment.

With the liquid crystal display device according to the sixth exemplary embodiment, the integrated threshold value is constituted with a positive-side threshold value t+1 and a negative-side threshold value t−1. Only in a case where the write integrated value WT reaches the negative-side threshold value t−1 from the positive side or in a case where the write integrated value WT reaches the positive-side threshold value t+1 from the negative side, the level of the polarity inversion signal POL is switched.

In other words, in the liquid crystal display device according to the sixth exemplary embodiment, the threshold value for judging the writing polarity is not defined as "value of write integrated value register=0" but set as arbitrary values of "t+" and "t−" on the positive side and the negative side, respectively. Judging of the writing polarity using the positive-side threshold value t+ and the negative-side threshold value t− is done as follows. That is, writing is done to the liquid crystal panel with the negative polarity in a range "value of write integrated value register>t+", with the positive polarity in a range "value of write integrated value register<t−", and without changing the polarity of the (n−1)-th frame in a range "t−<value of write integrated value register<t+", respectively.

Figure 19B:
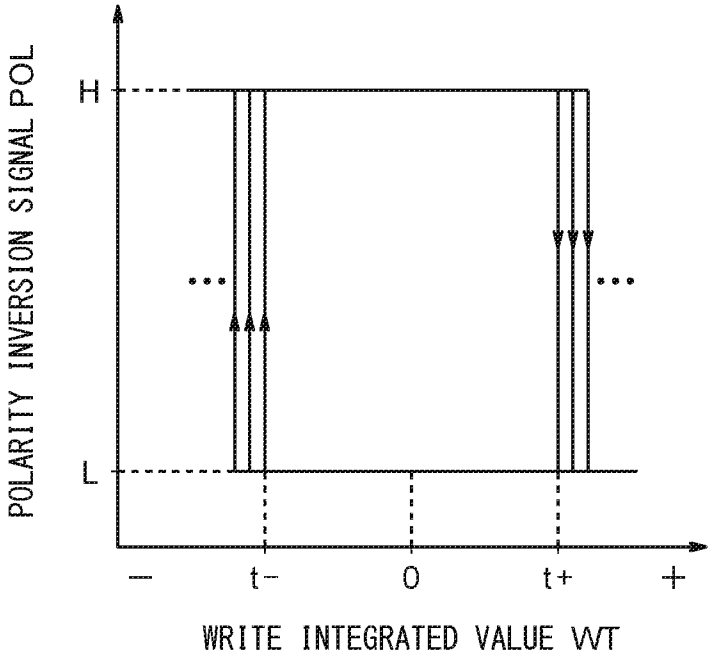
FIG. 19B is a graph showing the relation between the write integrated values and polarity inversion signals according to the sixth exemplary embodiment.
Figure 19A:
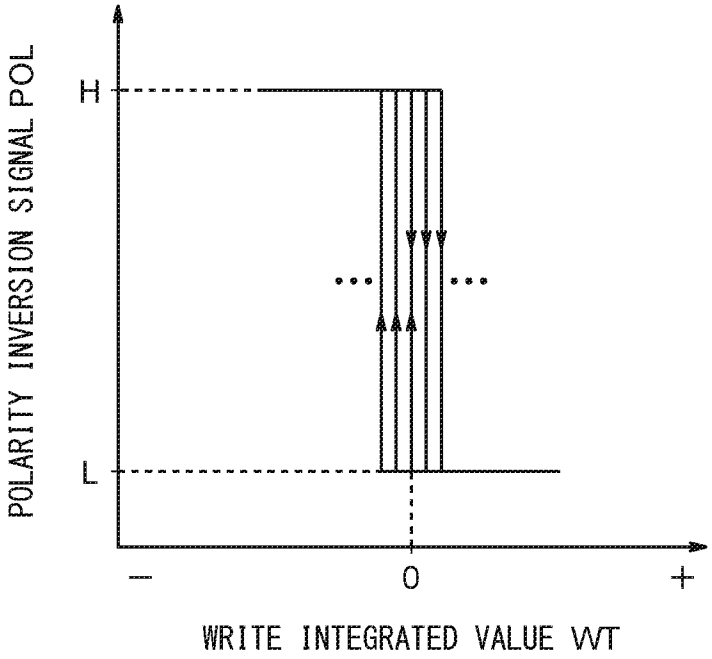
FIG. 19A is a graph showing the relation between the write integrated values and polarity inversion signals according to the first exemplary embodiment.

FIG. 19A is a graph showing the relation between the write integrated values WT and the polarity inversion signals POL according to the first exemplary embodiment. FIG. 19B is a graph showing the relation between the write integrated values WT and the polarity inversion signals POL according to the sixth exemplary embodiment. In the first exemplary embodiment shown in FIG. 19A, the polarity inversion signal POL is transited from low level to high level when the write integrated value WT reaches the integrated threshold value 0 from the positive side (+). Inversely, the polarity inversion signal POL is transited from high level to low level when the write integrated value WT reaches the integrated threshold value 0 from the negative side (−). In the meantime, in the sixth exemplary embodiment shown in FIG. 19B, the polarity inversion signal POL is transited from low level to high level when the write integrated value WT reaches the negative-side threshold value t− from the positive side (+) by going over the integrated threshold value 0. Inversely, the polarity inversion signal POL is transited from high level to low level when the write integrated value WT reaches the positive-side threshold value t+ from the negative side (−) by going over the integrated threshold value 0.

Figure 20:
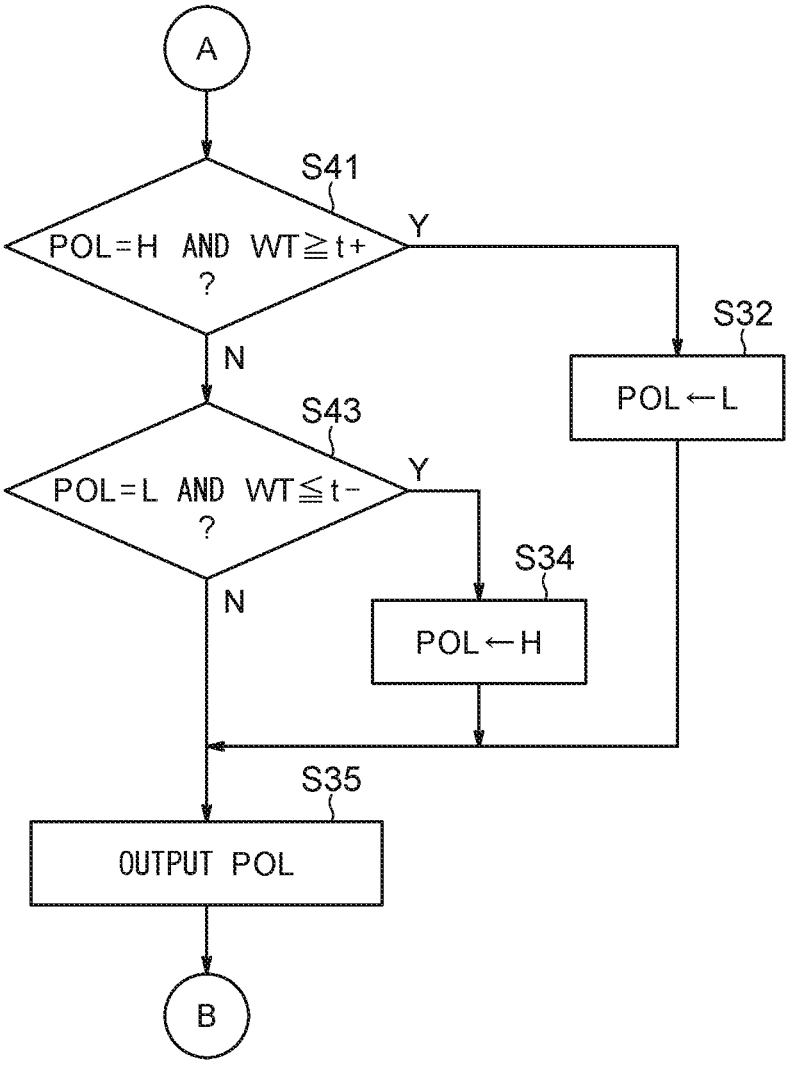
FIG. 20 is a flowchart showing a latter half of the actions of a write integrated value calculation unit according to the sixth exemplary embodiment.
Figure 21:
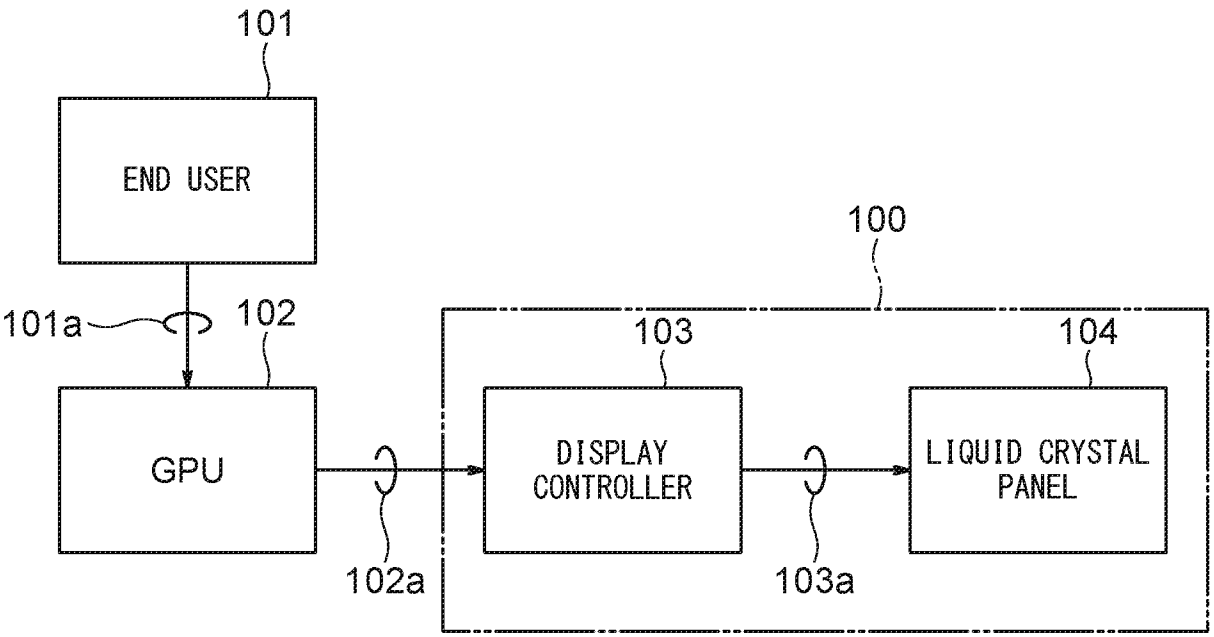
FIG. 21 is a block diagram showing a typical liquid crystal display device which displays moving pictures of a video game and its peripheral structures.

FIG. 20 is a flowchart showing the actions of the write integrated value calculation unit according to the sixth exemplary embodiment. In FIG. 20, "step S31 which judges whether or not the polarity inversion signal POL is high level and whether or not the write integrated value WT is 0 or larger" and "step S33 which judges whether or not the polarity inversion signal POL is low level and whether or not the write integrated value WT is 0 or smaller" in FIG. 10 are replaced with "step S41 which judges whether or not the polarity inversion signal POL is high level and whether or not the write integrated value WT is t+ or larger" and "step S43 which judges whether or not the polarity inversion signal POL is low level and whether or not the write integrated value WT is t− or smaller". Other steps S are the same as those of the first exemplary embodiment shown in FIG. 9A, FIG. 9B and FIG. 10. As in the case of the first exemplary embodiment, steps S43, S34 may be executed first and steps S41, S32 may be executed thereafter.

Figure 8B:
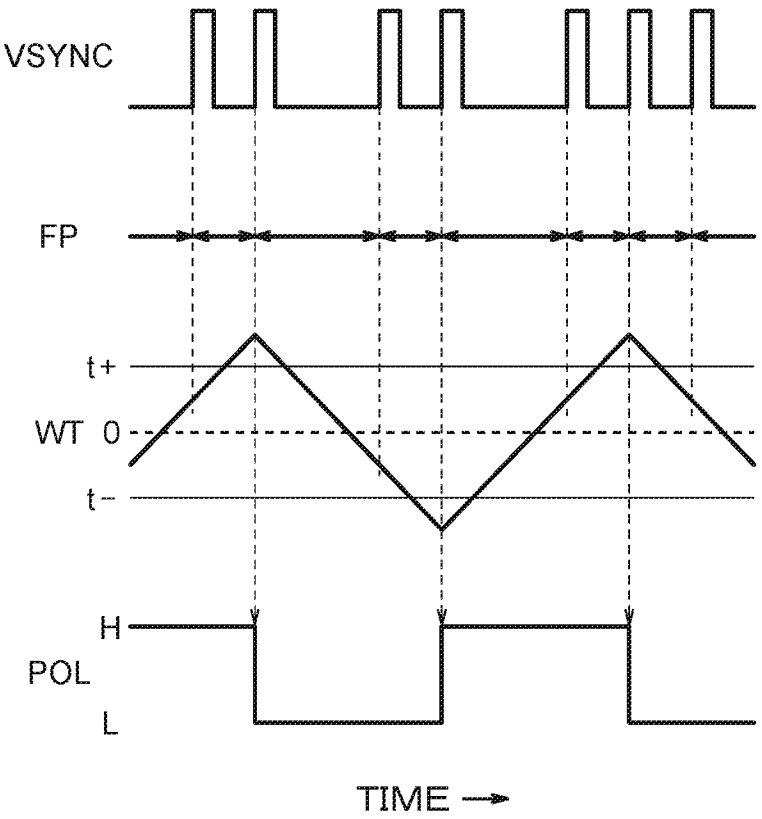
FIG. 8B is a timing chart showing a vertical synchronizing signal, a frame period, a write integrated value, and a polarity inversion signal according to a sixth exemplary embodiment.

FIG. 8B is a timing chart showing examples of a vertical synchronizing signal VSYNC, a frame period FP, a write integrated value WT, and a polarity inversion signal POL according to the sixth exemplary embodiment. In the first exemplary embodiment of FIG. 8A and the sixth exemplary embodiment of FIG. 8B, the vertical synchronizing signals VSYNC and the frame periods FP are the same. While the time where polarity inversion signals POL become high level H and the time where the signals POL become low level L are equivalent both in the first exemplary embodiment of FIG. 8A and the sixth exemplary embodiment of FIG. 8B, the switching frequency of the polarity inversion signal POL is less in the sixth exemplary embodiment of FIG. 8B.

Therefore, with the sixth exemplary embodiment, it is possible to decrease the switching frequency of the polarity inversion signal POL so that inversion of the writing polarity can be decreased, thereby making it possible to save the power.

Next, a more concrete Example of the sixth exemplary embodiment will be described.

Figure 16B:
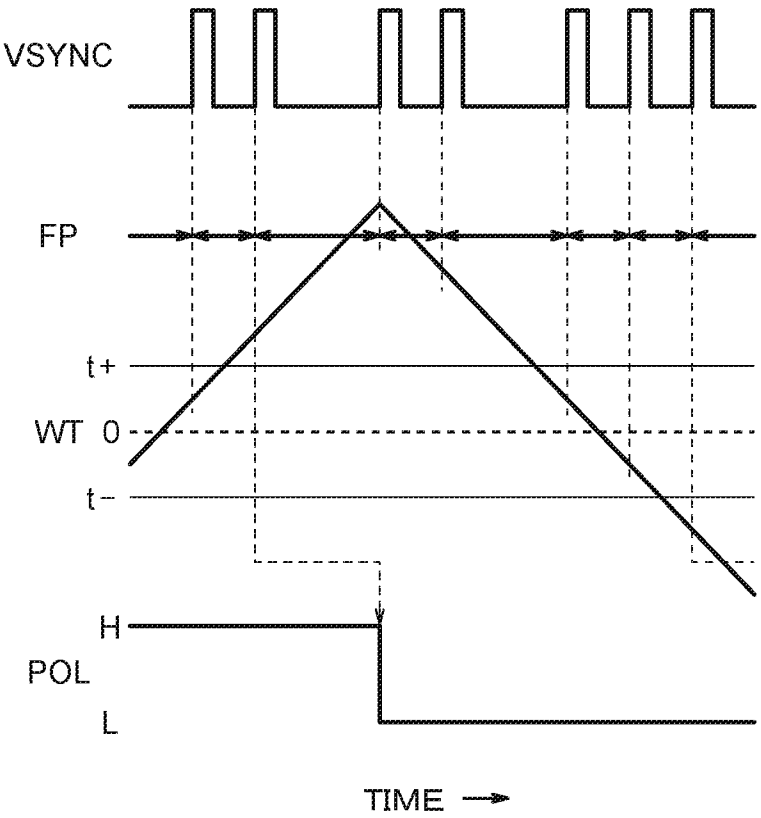
FIG. 16B is a timing chart showing vertical synchronizing signal, a frame period, a write integrated value, and a polarity inversion signal according to Example of the sixth exemplary embodiment.

FIG. 16B is a timing chart showing a vertical synchronizing signal, a frame period, a write integrated value, and a polarity inversion signal according to the sixth exemplary embodiment. This Example is a structure acquired by combining the fifth exemplary embodiment with the sixth exemplary embodiment, which is a case where m=1, i.e., a case where the timing for switching the polarity inversion signal POL is delayed for one frame in the sixth exemplary embodiment.

In the Example shown in FIG. 16A, the polarity inversion signal POL is transited from low level to high level at the rise of the (n+2)-th frame period FP after the write integrated value WT reaches t− from the positive side (+) by going over the integrated threshold value 0 in the n-th frame period FP. Inversely, the polarity inversion signal POL is transited from high level to low level at the rise of the (n+2)-th frame period after the write integrated value WT reaches t+ from the negative side (−) by going over the integrated threshold value 0 in the n-th frame period FP.

In the Example of FIG. 16B and the sixth exemplary embodiment of FIG. 8B, the vertical synchronizing signals VSYNC and the frame periods FP are the same. The switching frequency of the polarity inversion signal POL is less in the Example of FIG. 16B than in the sixth exemplary embodiment of FIG. 8B. It is because the absolute value of the write integrated value WT becomes increased for one frame when the timing for switching the polarity inversion signal POL is delayed for one frame, so that the time for reaching the integrated threshold value 0 becomes extended.

Therefore, with the Example, it is possible to decrease the switching frequency of the polarity inversion signal POL further so that inversion of the writing polarity can be decreased, thereby making it possible to save the power.

Other structures of the polarity inversion control device, the liquid crystal display device, and the driving method as well as the driving program thereof according to the sixth exemplary embodiment are the same as those of the first exemplary embodiment.

While the present invention has been described by referring to each of the above exemplary embodiments, the present invention is not limited only to the structures and the actions of each of the above-described exemplary embodiments. Regarding the structures and the details of the present invention, various kinds of changes and modifications occurred to those skilled in the art can be applied. Further, the present invention also includes those acquired by combining a part of or a whole part of each of the above-described exemplary embodiments as appropriate.

The present invention can be summarized as follows. The exemplary object of the present invention is to provide the liquid crystal display device with which the charging polarity to the liquid crystal panel is not deviated even when the writing frame rate to the liquid crystal panel changes dynamically only by adding relatively small-scale circuit structure and with relatively saved power. The present invention is structured to: detect the synchronizing signal and the clock signal inputted from outside; calculate deviation of the charging polarity to the liquid crystal panel at a certain point; and control the writing polarity when writing the next frame to the liquid crystal panel so that the deviation of the charging polarity becomes small according to the extent of the deviation. The effects of the present invention are that deviation of the charging polarity of the writing polarity can be suppressed for each frame and ghosting can be prevented without increasing the number of components as much as possible and with less power compared to the case of "double-speed drive" that is known in general.

While a part of or a whole part of the above-described exemplary embodiments can be depicted as following Supplementary Notes, the present invention is not limited only to the following structures.

(Supplementary Note 1)

A polarity inversion control device for liquid crystal display, which, for a liquid crystal panel which includes a plurality of pixels, applies pixel voltages of different frame periods to the pixels, and inverts polarities of the pixel voltages according to a polarity inversion signal that can employ either a first level or a second level for each of the frame periods when applying the pixel voltages to the pixels, switches the level of the polarity inversion signal in such a manner that a difference between an integrated value of the frame periods when the polarity inversion signal is in the first level and an integrated value of the frame periods when the polarity inversion signal is in the second level becomes small.

(Supplementary Note 2)

The polarity inversion control device for liquid crystal display as depicted in Supplementary Note 1, which includes:

a frame period detection unit which detects the frame period; and a write integrated value calculation unit which, regarding the frame period detected by the frame period detection unit, calculates a write integrated value that is a difference between the integrated value of the frame periods when the polarity inversion signal is in the first level and the integrated value of the frame periods when the polarity inversion signal is in the second level, and switches the level of the polarity inversion signal based on the write integrated value.

(Supplementary Note 3)

The polarity inversion control device for liquid crystal display as depicted in Supplementary Note 2, wherein the write integrated value calculation unit switches the level of the polarity inversion signal when the write integrated value reaches an integrated threshold value.

(Supplementary Note 4)

The polarity inversion control device for liquid crystal display as depicted in Supplementary Note 3, wherein:

the integrated threshold value is a value of zero; and the write integrated value calculation unit calculates the write integrated value by taking the frame period when the polarity inversion signal is in the first level as a positive value and the frame period when the polarity inversion signal is in the second level as a negative value, and switches the level of the polarity inversion signal when the write integrated value reaches the value of zero from a positive side or a negative side.

(Supplementary Note 5)

The polarity inversion control device for liquid crystal display as depicted in Supplementary Note 3, wherein:

the integrated threshold value is constituted with a positive-side threshold value and a negative-side threshold value; and the write integrated value calculation unit calculates the write integrated value by taking the frame period when the polarity inversion signal is in the first level as a positive value and the frame period when the polarity inversion signal is in the second level as a negative value, and switches the level of the polarity inversion signal only when the write integrated value reaches the negative-side threshold value from the positive side or when the write integrated value reaches the positive-side threshold value from the negative side.

(Supplementary Note 6)

The polarity inversion control device for liquid crystal display as depicted in Supplementary Note 4 or 5, wherein the write integrated value calculation unit delays timing for switching the level of the polarity inversion signal.

(Supplementary Note 7)

The polarity inversion control device for liquid crystal display as depicted in any one of Supplementary Notes 2 to 6, wherein the frame period detection unit inputs a vertical synchronizing signal and a clock signal, specifies the frame period by the two continuous vertical synchronizing signals, and count the clock signals in the specified frame period to detect the frame period.

(Supplementary Note 8)

The polarity inversion control device for liquid crystal display as depicted in Supplementary Note 7, further including a clock signal generation unit which generates the clock signal.

(Supplementary Note 9)

A liquid crystal display device, which includes the polarity inversion control device for liquid crystal display depicted in any one of Supplementary Notes 1 to 8 and the liquid crystal panel.

(Supplementary Note 10)

A driving method of a liquid crystal display device including a liquid crystal panel which includes a plurality of pixels, applies pixel voltages of different frame periods to the pixels, and inverts polarities of the pixel voltages according to a polarity inversion signal that can employ either a first level or a second level for each of the frame periods when applying the pixel voltages to the pixels, the method including:

detecting the frame period;

regarding the detected frame period, switching the level of the polarity inversion signal in such a manner that a difference between an integrated value of the frame periods when the polarity inversion signal is in the first level and an integrated value of the frame periods when the polarity inversion signal is in the second level becomes small; and supplying the switched polarity inversion signal to the liquid crystal panel.

(Supplementary Note 11)

A non-transitory computer readable recording medium storing a driving program of a liquid crystal display device including a liquid crystal panel which includes a plurality of pixels, applies pixel voltages of different frame periods to the pixels, and inverts polarities of the pixel voltages according to a polarity inversion signal that can employ either a first level or a second level for each of the frame periods when applying the pixel voltages to the pixels, the program causing a computer to execute:

a procedure for detecting the frame period;

regarding the detected frame period, a procedure for switching the level of the polarity inversion signal in such a manner that a difference between an integrated value of the frame periods when the polarity inversion signal is in the first level and an integrated value of the frame periods when the polarity inversion signal is in the second level becomes small; and a procedure for supplying the switched polarity inversion signal to the liquid crystal panel.

INDUSTRIAL APPLICABILITY

The present invention can be utilized for a liquid crystal display device and the like such as a liquid crystal display device for displaying moving pictures of video games, for example, which changes display fps in accordance with input fps.

What is claimed is:

1. A polarity inversion control device for a liquid crystal display panel having a plurality of pixels writeable with pixel voltages, comprising:

an output configured to couple a polarity inversion signal to the liquid crystal display panel, wherein the polarity inversion signal is based on frame periods of data representing the pixel voltages, and causes inversion of polarities of the pixel voltages;

a frame period detection unit which detects the frame period; and a write integrated value calculation unit configured to switch a level of the polarity inversion signal in such a manner that a difference between an integrated value generated by continuously integrating multiple different frame periods when the polarity inversion signal is in a first level and an integrated value generated by continuously integrating multiple different frame periods when the polarity inversion signal is in a second level becomes small, wherein the write integrated value calculation unit, regarding the frame period detected by the frame period detection unit, calculates the difference between the integrated value generated by continuously integrating multiple different frame periods when the polarity inversion signal is in the first level and the integrated value generated by continuously integrating multiple different frame periods when the polarity inversion signal is in the second level.

2. The polarity inversion control device as claimed in claim 1, wherein the write integrated value calculation unit switches the level of the polarity inversion signal when the write integrated value reaches an integrated threshold value.

3. The polarity inversion control device as claimed in claim 2, wherein:

the integrated threshold value is a value of zero; and the write integrated value calculation unit calculates the write integrated value by taking the frame period when the polarity inversion signal is in the first level as a positive value and the frame period when the polarity inversion signal is in the second level as a negative value, and switches the level of the polarity inversion signal when the write integrated value reaches the value of zero from a positive side or a negative side.

4. The polarity inversion control device as claimed in claim 3, wherein the write integrated value calculation unit delays timing for switching the level of the polarity inversion signal.

5. The polarity inversion control device as claimed in claim 2, wherein:

the integrated threshold value is constituted with a positive-side threshold value and a negative-side threshold value; and the write integrated value calculation unit calculates the write integrated value by taking the frame period when the polarity inversion signal is in the first level as a positive value and the frame period when the polarity inversion signal is in the second level as a negative value, and switches the level of the polarity inversion signal only when the write integrated value reaches the negative-side threshold value from the positive side or when the write integrated value reaches the positive-side threshold value from the negative side.

6. The polarity inversion control device as claimed in claim 5, wherein the write integrated value calculation unit delays timing for switching the level of the polarity inversion signal.

7. The polarity inversion control device as claimed in claim 1, wherein the frame period detection unit inputs a vertical synchronizing signal and a clock signal, specifies the frame period by the two continuous vertical synchronizing signals, and count counts the clock signals in the specified frame period to detect the frame period.

8. The polarity inversion control device as claimed in claim 7, further comprising a clock signal generation unit which generates the clock signal.

9. A liquid crystal display device, comprising the polarity inversion control device claimed in claim 1 and the liquid crystal panel.

10. A driving method of a liquid crystal display device comprising a liquid crystal panel which includes a plurality of pixels, applies pixel voltages of different frame periods to the pixels, and inverts polarities of the pixel voltages according to a polarity inversion signal that is configured to employ either a first level or a second level for each of the frame periods when applying the pixel voltages to the pixels, the method comprising:

detecting, by a frame period detection unit, the frame period;

regarding the detected frame period, switching the level of the polarity inversion signal in such a manner that a difference between an integrated value generated by continuously integrating multiple different frame periods when the polarity inversion signal is in the first level and an integrated value generated by continuously integrating multiple different frame periods when the polarity inversion signal is in the second level becomes small, wherein a write integrated value calculation unit calculates the difference between the integrated value generated by continuously integrating multiple different frame periods when the polarity inversion signal is in the first level and the integrated value generated by continuously integrating multiple different frame periods when the polarity inversion signal is in the second level; and supplying the switched polarity inversion signal to the liquid crystal panel.

* * * * *